US008607774B2

(12) United States Patent
Davis

(10) Patent No.: US 8,607,774 B2
(45) Date of Patent: Dec. 17, 2013

(54) VORTEX RING PRODUCING GUN

(75) Inventor: Jeffery M. Davis, Manassas, VA (US)

(73) Assignee: Jeffery M. Davis, Manassas, VA (US)

( * ) Notice: Subject to any disclaimer, the term of this patent is extended or adjusted under 35 U.S.C. 154(b) by 636 days.

(21) Appl. No.: 12/570,798

(22) Filed: Sep. 30, 2009

(65) Prior Publication Data

US 2010/0015879 A1 Jan. 21, 2010

Related U.S. Application Data

(60) Provisional application No. 61/233,705, filed on Aug. 13, 2009.

(51) Int. Cl.
*A63H 33/28* (2006.01)

(52) U.S. Cl.
USPC ..... 124/55

(58) Field of Classification Search
USPC ..... 124/55, 56
See application file for complete search history.

(56) References Cited

U.S. PATENT DOCUMENTS

| | | | | |
|---|---|---|---|---|
| 1,473,178 | A | 11/1923 | Dray | |
| 1,611,533 | A | 12/1926 | Kirsten | |
| 1,926,585 | A | 9/1933 | Gibbons | |
| 2,150,614 | A | 3/1939 | Sutkowski | |
| 2,534,398 | A | 12/1950 | Beathan | |
| 2,540,060 | A | 1/1951 | Szantay | |
| 2,543,651 | A * | 2/1951 | Weiss | 124/55 |
| 2,614,551 | A | 10/1952 | Shelton | |
| 2,628,450 | A | 2/1953 | Shelton | |
| 2,846,996 | A * | 8/1958 | Drynan | 124/55 |
| 2,855,714 | A * | 10/1958 | Thomas | 42/57 |
| 2,879,759 | A * | 3/1959 | Webb | 124/55 |
| 2,885,714 | A | 5/1959 | Johnson | |
| 3,117,567 | A | 1/1964 | Allen, Jr. | |
| 3,342,171 | A | 9/1967 | Ryan et al. | |
| 3,465,741 | A | 9/1969 | Daniel et al. | |
| 3,589,603 | A | 6/1971 | Fohl | |
| 3,884,471 | A | 5/1975 | Maurer et al. | |
| 4,005,014 | A | 1/1977 | Wikey | |
| 4,157,703 | A * | 6/1979 | Brown et al. | 124/55 |
| D259,335 | S | 5/1981 | Gillespie | |
| 4,534,914 | A | 8/1985 | Takahashi et al. | |
| 5,100,242 | A | 3/1992 | Latto | |
| 5,159,956 | A | 11/1992 | Kurihara | |
| 5,218,986 | A | 6/1993 | Farwell | |
| 5,947,784 | A | 9/1999 | Cullen | |
| 6,421,502 | B1 | 7/2002 | Aronie et al. | |
| 6,488,270 | B2 | 12/2002 | Whiteis | |
| 6,694,658 | B1 | 2/2004 | Marsac | |
| 6,824,125 | B2 | 11/2004 | Thomas | |
| 6,983,742 | B2 | 1/2006 | Jordan et al. | |
| 7,191,774 | B2 | 3/2007 | Thorne | |
| 7,300,040 | B2 | 11/2007 | Thomas | |
| 2002/0074673 | A1 | 6/2002 | Whiteis | |
| 2003/0034020 | A1 | 2/2003 | Irizarry et al. | |
| 2004/0088894 | A1 | 5/2004 | Haughton et al. | |
| 2004/0255922 | A1 * | 12/2004 | Thorne | 124/61 |
| 2007/0200260 | A1 | 8/2007 | Whiteis | |

* cited by examiner

*Primary Examiner* — Gene Kim
*Assistant Examiner* — Amir Klayman
(74) *Attorney, Agent, or Firm* — Lowe Hautpman & Ham, LLP

(57) ABSTRACT

A gun for producing a ring of fluid is described. The gun comprises a body defining a bore therethrough; a moveable member positioned at least partially within the bore; and a nozzle assembly coupled with the body and positioned at a bore opening. The nozzle assembly defines one or more fluid entrapment regions adjacent an opening of the nozzle assembly.

30 Claims, 26 Drawing Sheets

VORTEX RING PRODUCING GUN

RELATED APPLICATIONS

The present application is based on, and claims priority from, U.S. Provisional Application No. 61/233,705, filed Aug. 13, 2009, the disclosure of which is hereby incorporated by reference herein in its entirety.

BACKGROUND

There are existing novelty devices, such as toy guns, which produce a puff of air or vortex rings of air. Accuracy and safety have been among considerations that have defined the features of some of these devices.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Figure 1:
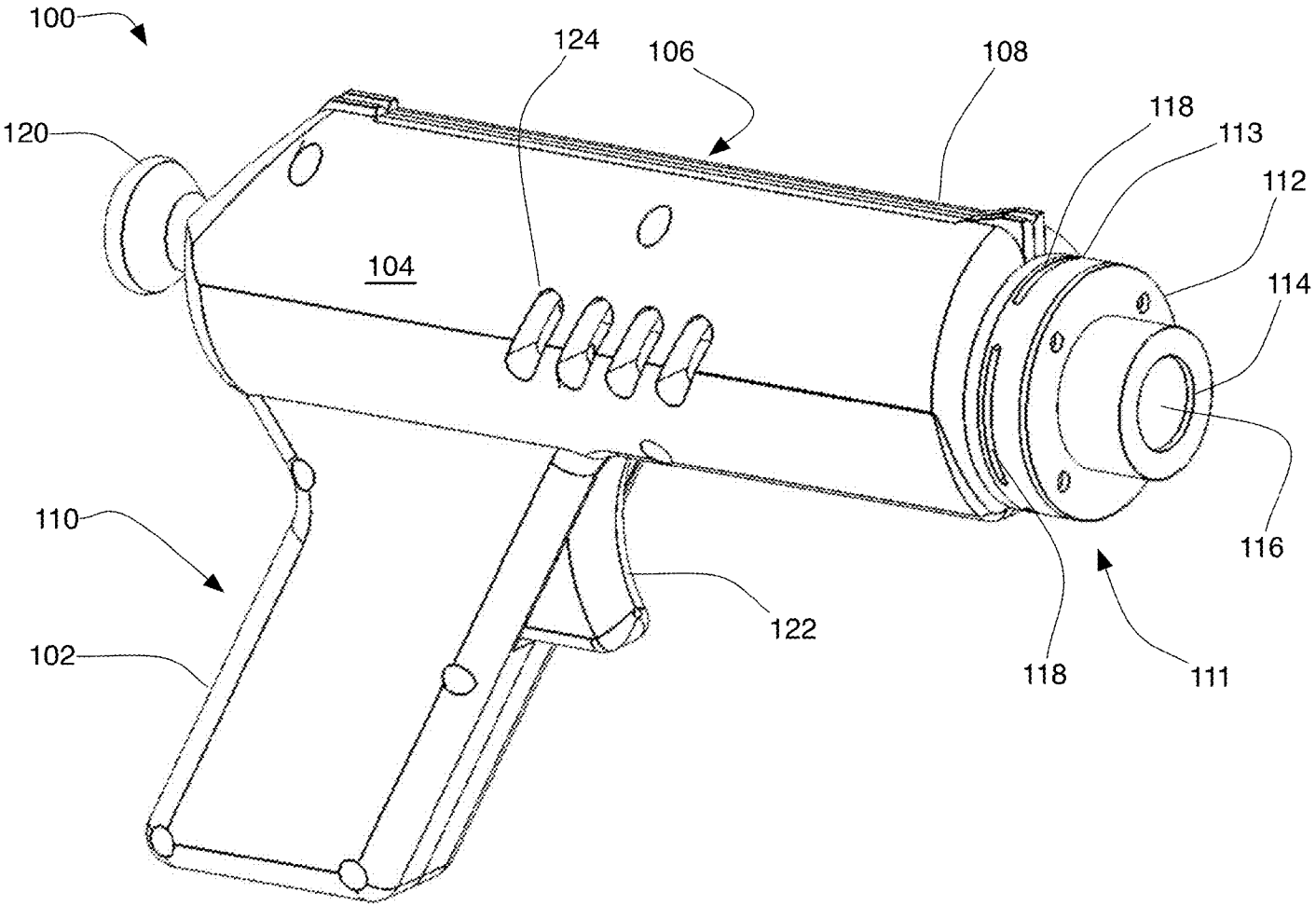
FIG. 1 is a perspective view of a vortex ring gun according to an embodiment.

FIG. 1 depicts a perspective view of a vortex ring gun 100 (also referred to herein as ring gun, toy gun, air gun, or gun) according to an embodiment. Vortex ring gun 100 comprises a body 102 which, in at least some embodiments, is comprised of a molded plastic material. In at least some embodiments, body 102 comprises a right half 104 and a left half 106 along a centerline of the gun, e.g., along a center of a barrel 108 of the gun. Body 102 also comprises a grip 110 extending from barrel 108. Operation of vortex ring gun 100 causes the production and propulsion of a vortex ring of fluid from a nozzle of the gun. In at least some embodiments, the vortex ring produced includes a second fluid, e.g., air or another gas, or a colored fluid, or colorant, within the vortex ring. In at least some embodiments, gun 100 comprises a blockage element operating as a safety device and/or a fluid accelerator. In at least some other embodiments, gun 100 comprises one or more pressure limiting vents operating in conjunction with the central blockage to limit pressure in the event a nozzle of the gun is blocked. In at least some embodiments, pressure limiting vents operate separate from the central blockage to limit pressure in the event a nozzle of the gun is blocked.

In at least some embodiments, right half 104 and left half 106 are substantially mirror images of each other. In at least some embodiments, body 102 is comprised of a single piece of material, e.g., a single molded piece formed around the interior parts. In at least some embodiments, body 102 is comprised of a shaped plastic material. In at least some embodiments, body 102 is comprised of a metal, wood, fiber, and/or other material.

Gun 100 also comprises a nozzle assembly 111 coupled with body 102. Nozzle assembly 111 comprises a nozzle 112 and a joint ring 113. In at least some embodiments, nozzle assembly 111 comprises nozzle 112 separate from joint ring 113 and in other embodiments nozzle assembly 111 comprises an integrated nozzle 112 and joint ring 113. Nozzle 112 is coupled with barrel 108 of the gun. Nozzle 112 is generally cylindrical-shaped. In at least some embodiments, nozzle 112 comprises a stepped cylindrical shape. In at least some embodiments, nozzle 112 is a stepped right cylindrical shape; however, other shapes are within the scope of the present embodiments, e.g., the nozzle in some embodiments may be of a curvilinear nature. Nozzle 112 is connected at one end of barrel 108 via a joint ring 113 and comprises an opening (nozzle opening) 114 in line with a bore within the barrel. Nozzle 112 defines a nozzle bore 116 longitudinally aligned with a bore of barrel 108 and extending through the nozzle from the side adjacent the barrel to nozzle opening 114. Joint ring 113 also comprises four pressure venting slots 118 circumferentially spaced around the exterior of the joint ring. In at least some embodiments, joint ring 113 comprises greater or fewer numbers of pressure venting slots 118. Pressure venting slots 118 are generally slit-shaped and, in at least some embodiments, comprise a rounded end. Joint ring 113 defines a fluid passageway extending from an interior surface of the nozzle assembly to the exterior of the nozzle assembly and terminating at the pressure venting slots 118. In at least some embodiments, the defined fluid passageway extends radially away from the centerline of joint ring 113.

Gun 100 also comprises a knob (puller) 120 coupled with a piston positioned inside the bore of barrel 108. The knob 120 and connected piston extend longitudinally along the bore and are slidably movable along the bore. In at least some other embodiments, the piston comprises a moveable member such as a flexible diaphragm or other mechanism. A biasing mechanism, e.g., a spring, causes the knob and piston to be positioned closer to nozzle 112. A trigger 122 extends from grip 110, and in cooperation with a catch mechanism, is used by a user to alternately retain knob 120 and piston away from nozzle 112 and release the piston allowing the biasing mechanism to propel the piston toward the nozzle.

In at least some embodiments, trigger 122 extends from barrel 108. In at least some embodiments, gun 100 lacks a trigger 122 and the user holds knob 120 in a retracted position and in at least some other embodiments, knob 120 is biased in a retracted position.

In operation, knob 120 is gripped by a user and manipulated to pull the piston back along the bore away from nozzle 112. In a fully retracted position with knob 120 and piston pulled fully away from nozzle 112, gun 100 is said to be in a cocked or ready position.

Further, a user manipulating or pulling trigger 122 causes release of the piston and expulsion of fluid within the bore of barrel 108 toward nozzle opening 114. Due at least in part to the configuration of nozzle 112, the fluid passing through nozzle opening 114 on exiting the opening forms a vortex ring of fluid moving away from gun 100.

Gun 100 also comprises eight intake slots 124 (four intake slots through each half of the gun) defined along barrel 108. Intake slots 124 form passageways between the interior of the bore within barrel 108 and the exterior of gun 100. In at least some embodiments, intake slots 124 are generally rounded elongated openings. Fluid exterior of gun 100 enters the gun by way of at least intake slots 124.

In at least some embodiments, gun 100 comprises greater or fewer number of intake slots 124. In at least some embodiments, intake slots 124 comprise different shapes and/or different placement on barrel 108.

Figure 2:
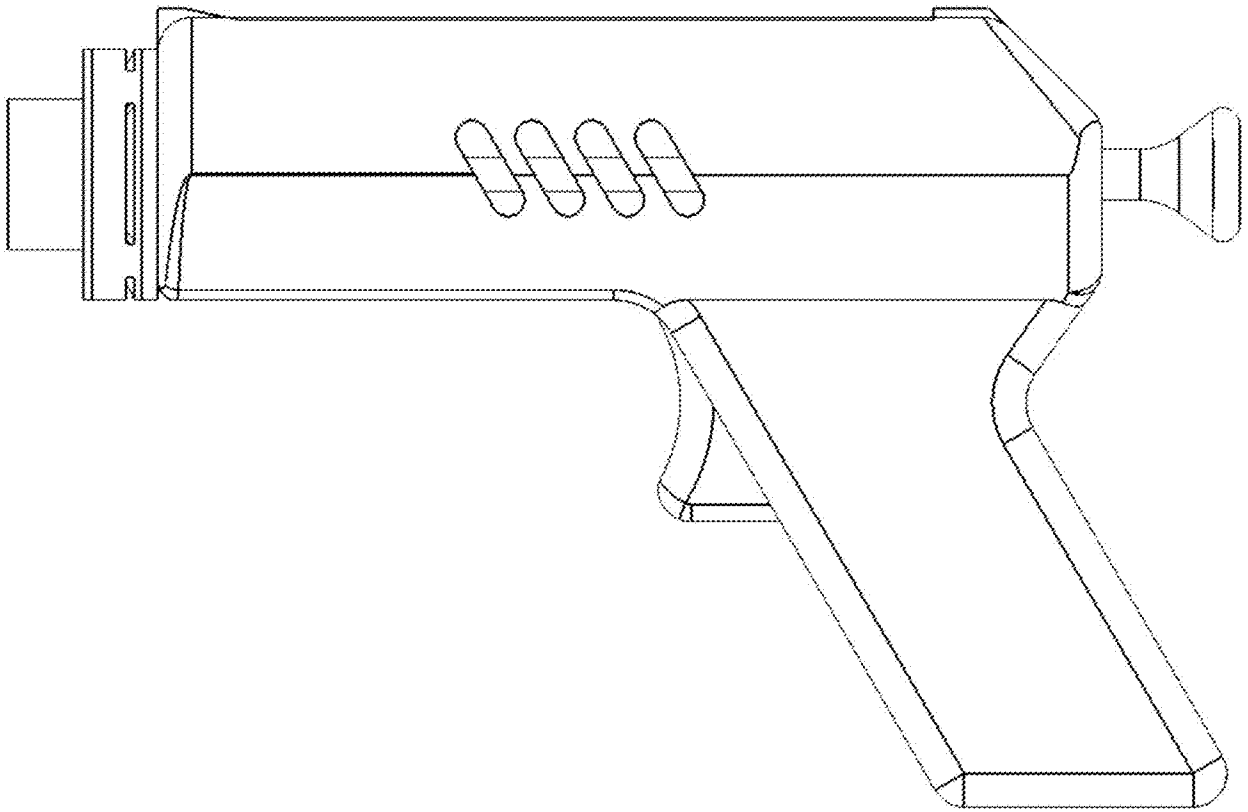
FIG. 2 is a side view of the vortex ring gun of FIG. 1.

FIG. 2 depicts a side view of the vortex ring gun of FIG. 1.

Figure 3:
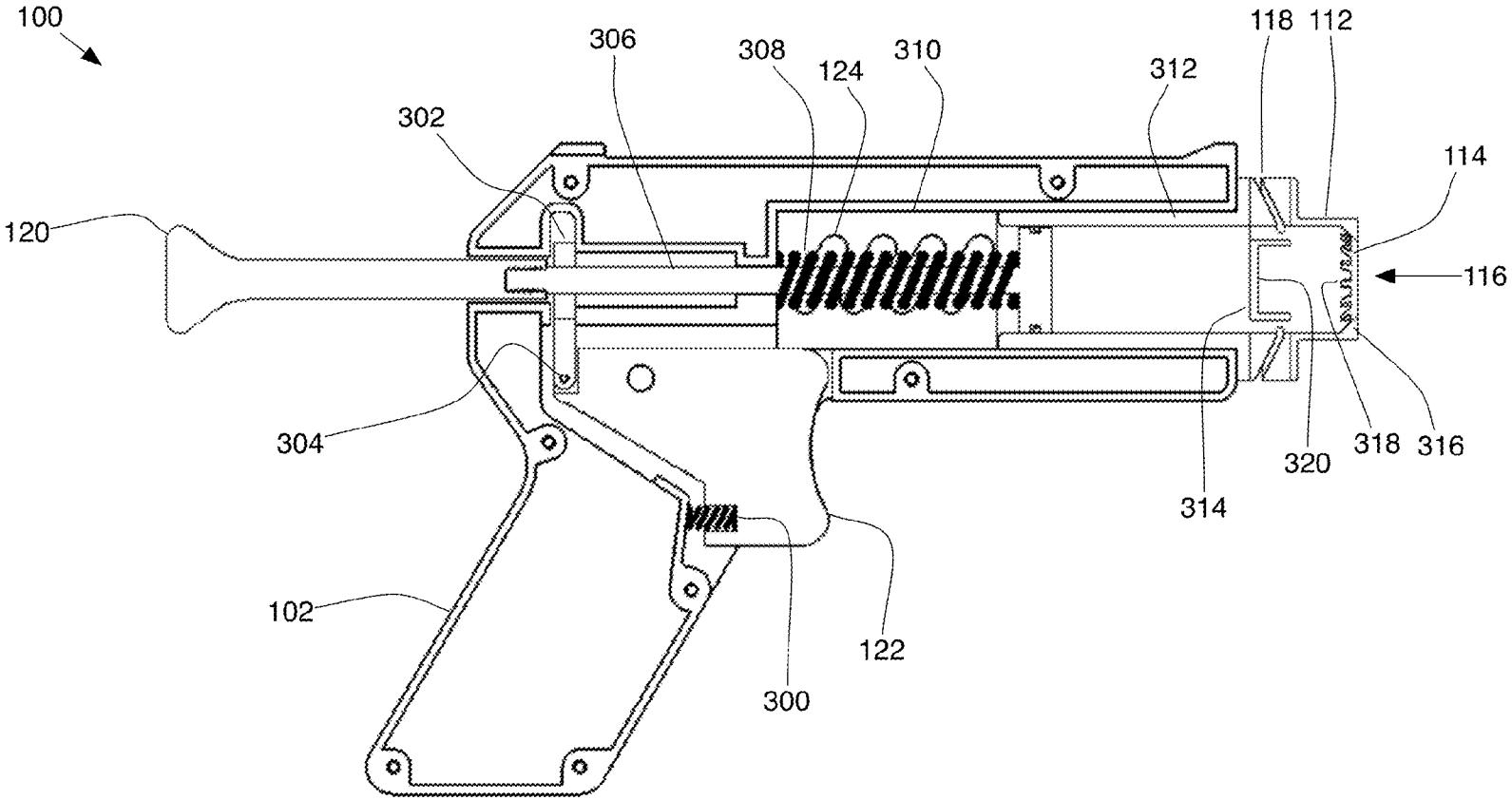
FIG. 3 is a side section view of the vortex ring gun of FIG. 1.

FIG. 3 depicts a side section view of the vortex ring gun of FIG. 1.

Gun 100 also comprises a trigger spring 300 coupling trigger 122 to body 102 in a biased manner, a catch 302, a catch pin 304, a piston 306 coupled with knob 120, a piston spring 308 positioned in intermittent contact with piston 306, a bore 310, a bore sleeve 312 positioned at least partially within the bore and coupled with joint ring 113. In at least some embodiments, bore sleeve 312 coupled with joint ring 113 further couples nozzle 112 to gun 100.

In at least some embodiments, nozzle assembly 111 comprises nozzle 112, joint ring 113, and bore sleeve 312, in combination. In at least some further embodiments, two or more of nozzle 112, joint ring 113, and/or bore sleeve 312 may be integrated into a single element forming nozzle assembly 111.

Joint ring 113 comprises a central blockage 314 positioned within nozzle bore 116. Central blockage 314 is cylindrical-shaped. In at least some embodiments, central blockage 314 may be a different size and/or shape. In at least some embodiments, an area of a face of central blockage 314 facing piston 306 is greater than half of the area of the piston face. In at least some embodiments, central blockage 314 may be positioned off-center of nozzle bore 116. In at least some other embodiments, central blockage 314 may comprise non-straight, i.e., curvilinear, sidewalls.

Nozzle 112, and more specifically the interior of nozzle opening 114, comprises a lip 316 at the interior of the nozzle opening of the inner surface of the nozzle interior. In at least some embodiments, lip 316 extends at an angle from a sidewall of nozzle 112 interior to the edge of nozzle opening 114.

In at least some embodiments, lip 316 extends at an angle along a straight line from sidewall to the nozzle opening 114. In at least some other embodiments, lip 316 extends along a curvilinear path from sidewall to the nozzle opening 114.

Lip 316 comprises a plurality of fluid entrapment ribs 318. In at least some embodiments, fluid entrapment ribs are circumferentially-spaced around nozzle opening 114. In at least some embodiments, ribs 318 completely surround nozzle opening 114. In at least some embodiments, ribs 318 do not completely surround nozzle opening 114 and instead may be irregularly or otherwise spaced around the nozzle opening.

When the puller or knob 120 is pulled back, trigger spring 300 causes catch 302 to move into a position that retains the puller in a cocked position, thereby storing the pulling energy in the piston spring 308. When the barrel is full of fluid, e.g., water, and the trigger is pulled, the fluid is forced around the central blockage and out the nozzle at high speed. In at least some embodiments, the barrel need not be full of fluid prior to release of trigger and propulsion of fluid through nozzle 112. Simultaneously, fluid is also drawn in behind the piston through intake slots 124 in the grip body. The lip 316 at the output of the nozzle causes a peripheral blockage that is similar to the central blockage in that both provide approximately the same proportion of blockage of the maximum flow area defined by the sleeve diameter. Thus, the velocity of the fluid flowing around the central blockage is approximately the same as the velocity of the fluid flowing through the peripheral blockage of the nozzle.

If a second fluid, e.g., ambient air or another gas, colored water or other fluid, has been trapped within fluid entrapment ribs 318 of the nozzle prior to firing, then the second fluid will be entrained within the high speed flow of the fast moving first fluid as the first fluid passes the fluid entrapment ribs prior to exiting the nozzle. In at least some embodiments, being of lower density than the first fluid, the entrained second fluid will be forced to the vortex core by the circulating first fluid of the vortex ring as it forms directly outside the nozzle. If no second fluid was trapped within the fluid entrapment ribs of the nozzle prior to firing, then a vortex ring composed of only the first fluid will be formed directly outside the nozzle. In either case, a certain proportion of the pulling energy is stored as rotational energy in the vortex ring, and another proportion is observed as the kinetic translation of the vortex ring through the ambient surrounding fluid. The remaining proportion of the original pulling energy is lost to viscous and frictional heating.

Under normal firing conditions where the nozzle is unobstructed, high speed fluid passes by the pressure venting slots 118, but no fluid is expelled through said slots because the pressure of the high speed fluid is reduced due to the venturi effect. In at least some embodiments, a minimal amount of fluid may be expelled through the pressure venting slots even if there is no obstruction. If the gun is fired and the nozzle is obstructed, then the maximum peak pressure upon the obstruction will be limited because fluid will flow out through the pressure venting slots, and not past said slots.

A dry soluble colorant formed into a pellet, or a concentrated liquid colorant in a porous capsule, may be inserted into the orifice 320 present on the central blockage, so that the expelled fluid will pick up colorant as it exits the gun, or during intervals between firings. This will produce colored traveling vortex rings.

Figure 4:
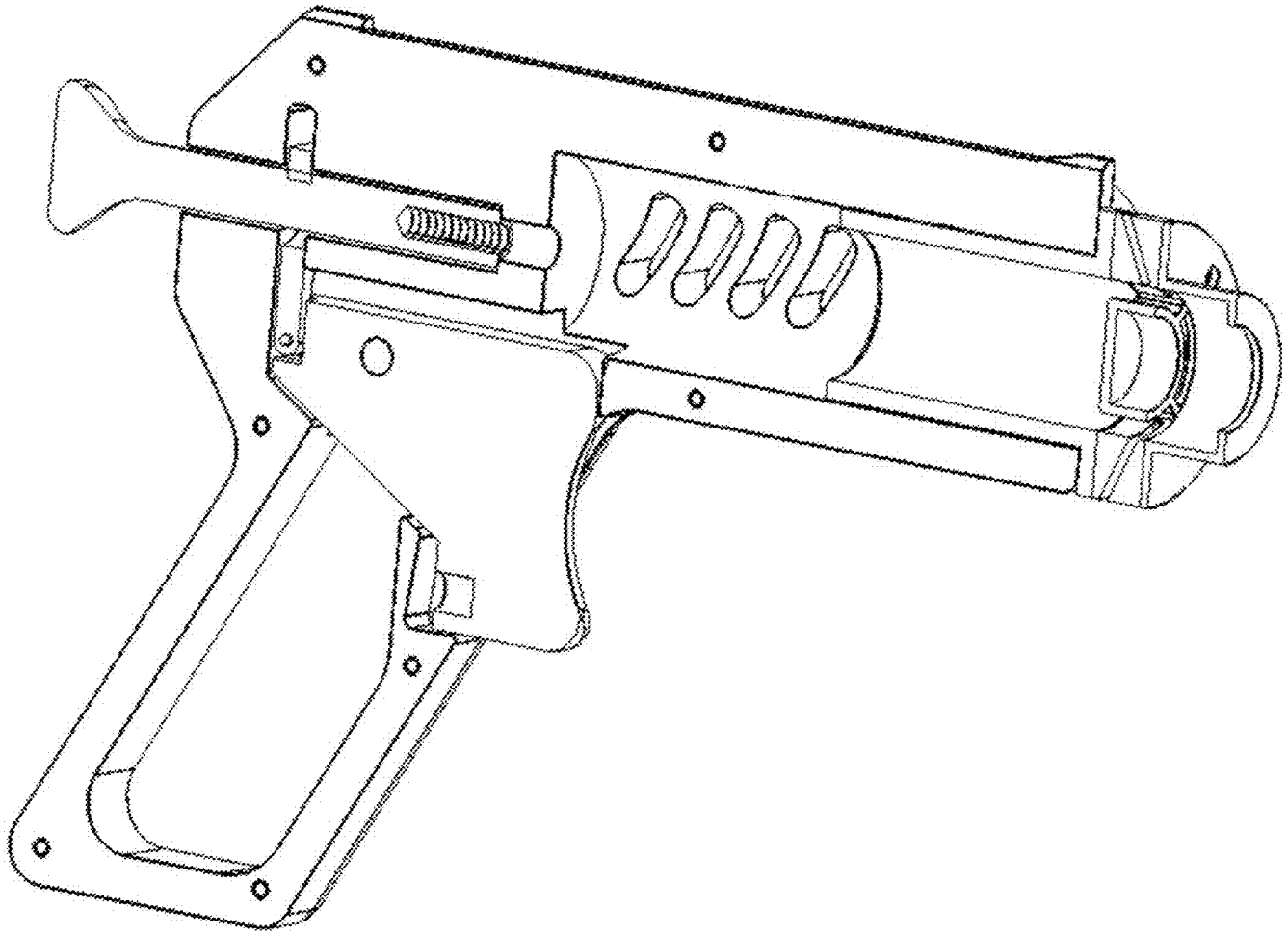
FIG. 4 is a perspective section view of the vortex ring gun of FIG. 1.

FIG. 4 depicts a perspective section view of the vortex ring gun of FIG. 1.

Disclosed herein is a novel design for a gun, e.g., a toy gun, that is usable under water in swimming pools, bathtubs, or other bodies of water. The gun is cocked above or below the water's surface. When the gun is cocked, and placed under water, the barrel is pointed upward to release air bubbles, and thereby fill with water. The nozzle may then be raised slightly out of the water, and lowered back into the water in order to entrap a specific amount of air within the air entrapment ribs inside the nozzle. Next, the gun is fired under water. The gun will emit a rotating vortex ring that travels under water to a target. If the nozzle was loaded with air, the vortex ring will be composed of spinning water with a core of air. This air filled ring will be visible underwater due to the difference in index of refraction of the two materials. If no air is loaded into the nozzle, then the vortex ring emitted from the gun is invisible as it travels underwater. In either case, the vortex ring carries energy in the forms of angular momentum and translational momentum to a target.

There are two integrated safety features in this design. The first safety feature is a central blockage placed inside the barrel close to the exit nozzle; so that foreign objects cannot be pushed into the barrel, come in contact with the moving internal parts, and thereby be ejected from the gun when fired. The central blockage has a second function also. Fluid flows around the perimeter of the central blockage and is thereby accelerated to a higher velocity.

The second safety feature is a plurality of pressure venting slots situated in proximity to the accelerated fluid flow caused by the central blockage; so as to take advantage of the venturi effect caused by said fast moving fluid. Normally, the nozzle will not be blocked when the gun is fired; and fast moving fluid will cause a low pressure at the pressure venting slots so that no fluid is ejected from said slots. If the nozzle is blocked, and the gun is fired; fluid will be ejected from the pressure venting slots because there is no fast moving fluid passing said vents to cause a drop in pressure at said vent openings.

Additionally, a dry soluble colorant formed into a pellet, or a concentrated liquid colorant in a porous capsule, may be inserted into an orifice present on the central blockage, so that the expelled fluid will pick up colorant as it exits the gun, or during intervals between firings. This will produce colored traveling vortex rings.

Figure 5:
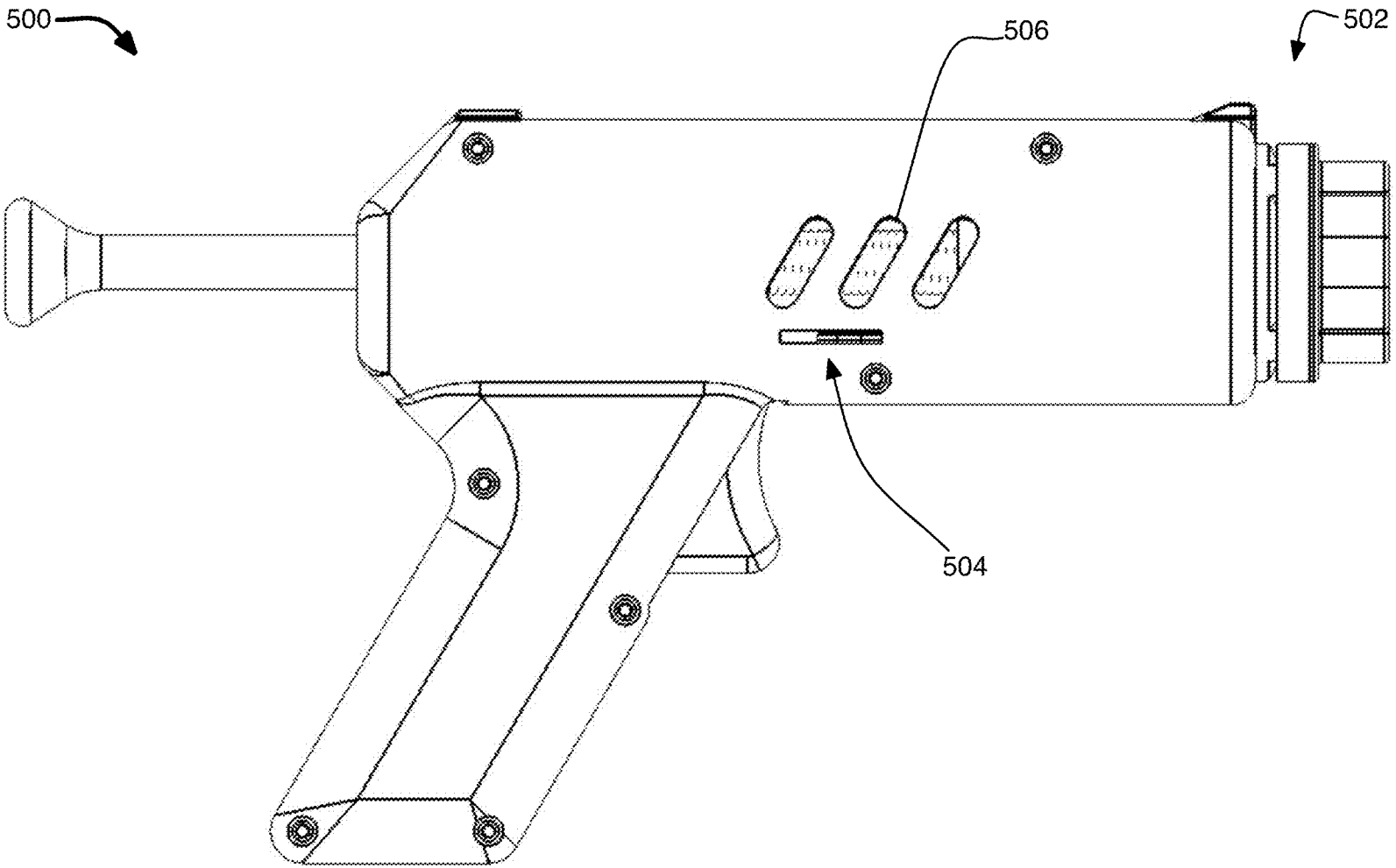
FIG. 5 is a side view of a vortex ring gun according to another embodiment.

FIG. 5 is a side view of a vortex ring gun 500, according to another embodiment. Vortex ring gun 500 is similar to gun 100 (FIG. 1). Gun 500 differs from gun 100 from an exterior view in that gun 500 comprises a different nozzle and joint ring configuration (generally referred to by reference 502 and in combination with a bore sleeve within the gun the components corresponding to a nozzle assembly) and comprises a shutter mechanism (generally referred to by reference 504) with respect to the intake slots. In at least some embodiments, gun 500 may comprise either one of nozzle and joint ring configuration (nozzle assembly) 502 or shutter mechanism 504, or both. Additionally, gun 500 comprises six intake slots 506 (three on each side) in comparison to the eight intake slots 124 of gun 100. In at least some other embodiments, gun 500 may comprise greater or fewer number of intake slots.

Figure 6:
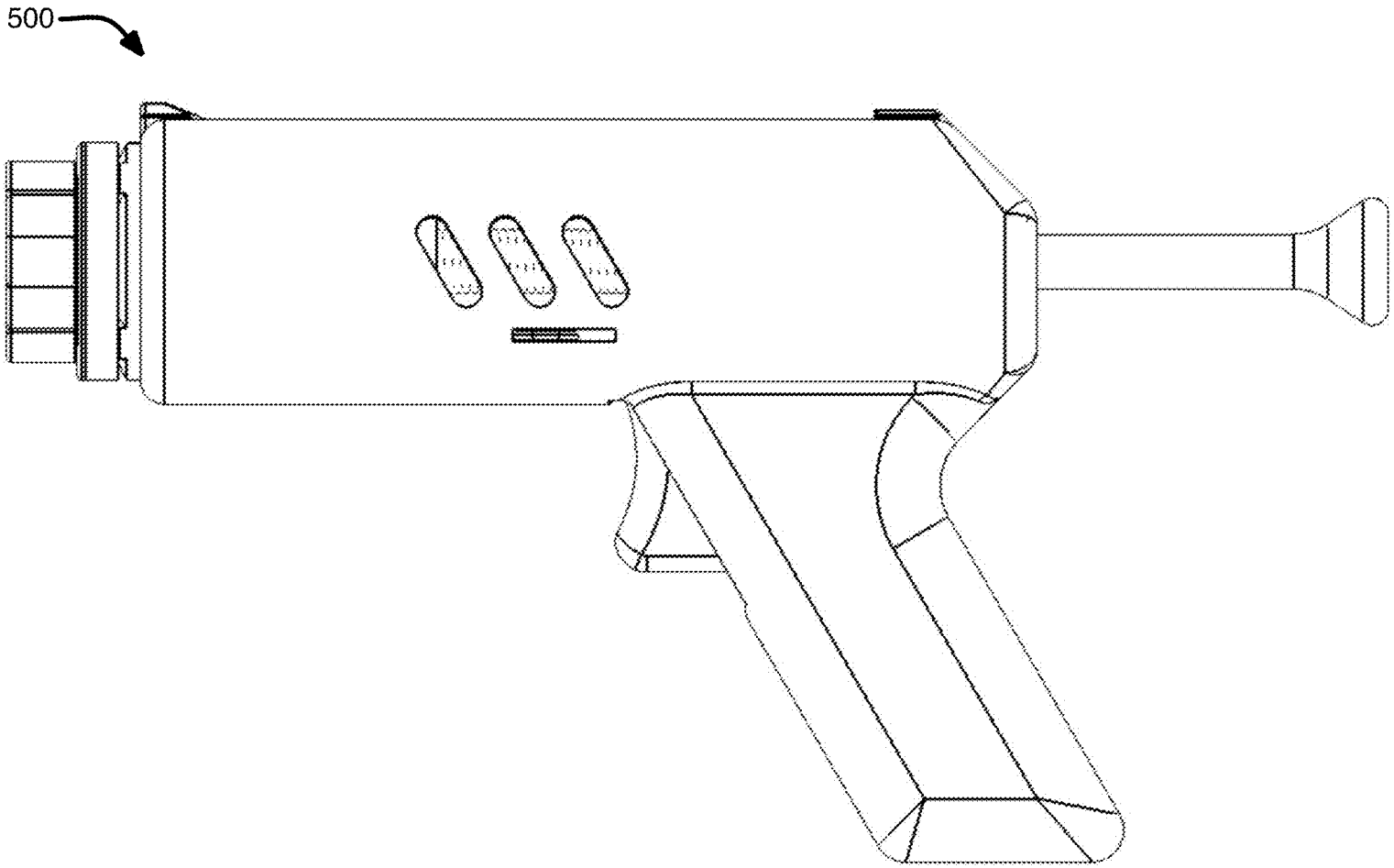
FIG. 6 is another side view of the vortex ring gun of FIG. 5.

FIG. 6 is another side view of gun 500.

Figure 7:
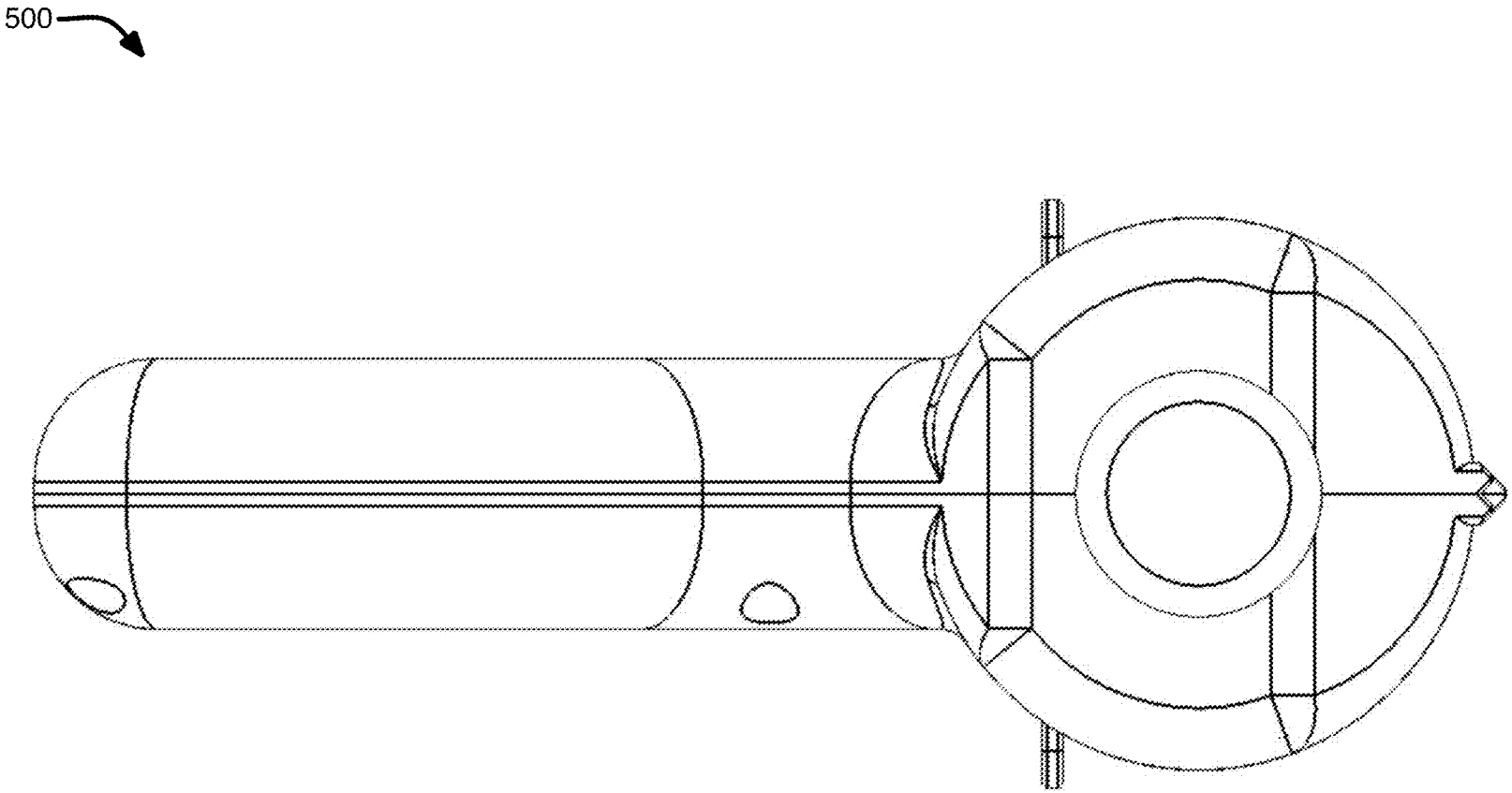
FIG. 7 is a rear plan view of the vortex ring gun of FIG. 5.

FIG. 7 is a rear plan view of gun 500.

Figure 8:
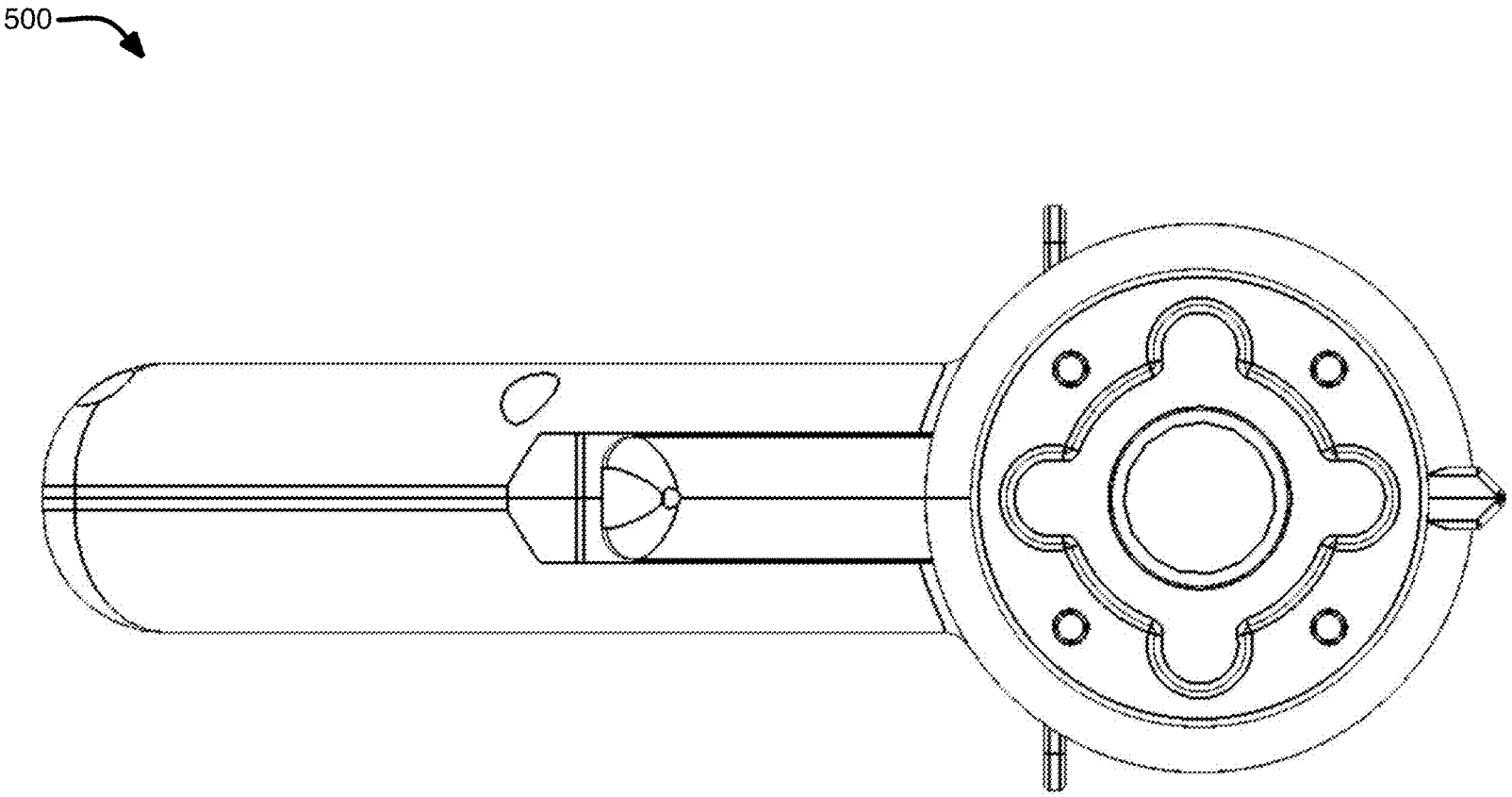
FIG. 8 is a front plan view of the vortex ring gun of FIG. 5.

FIG. 8 is a front plan view of gun 500.

Figure 9:
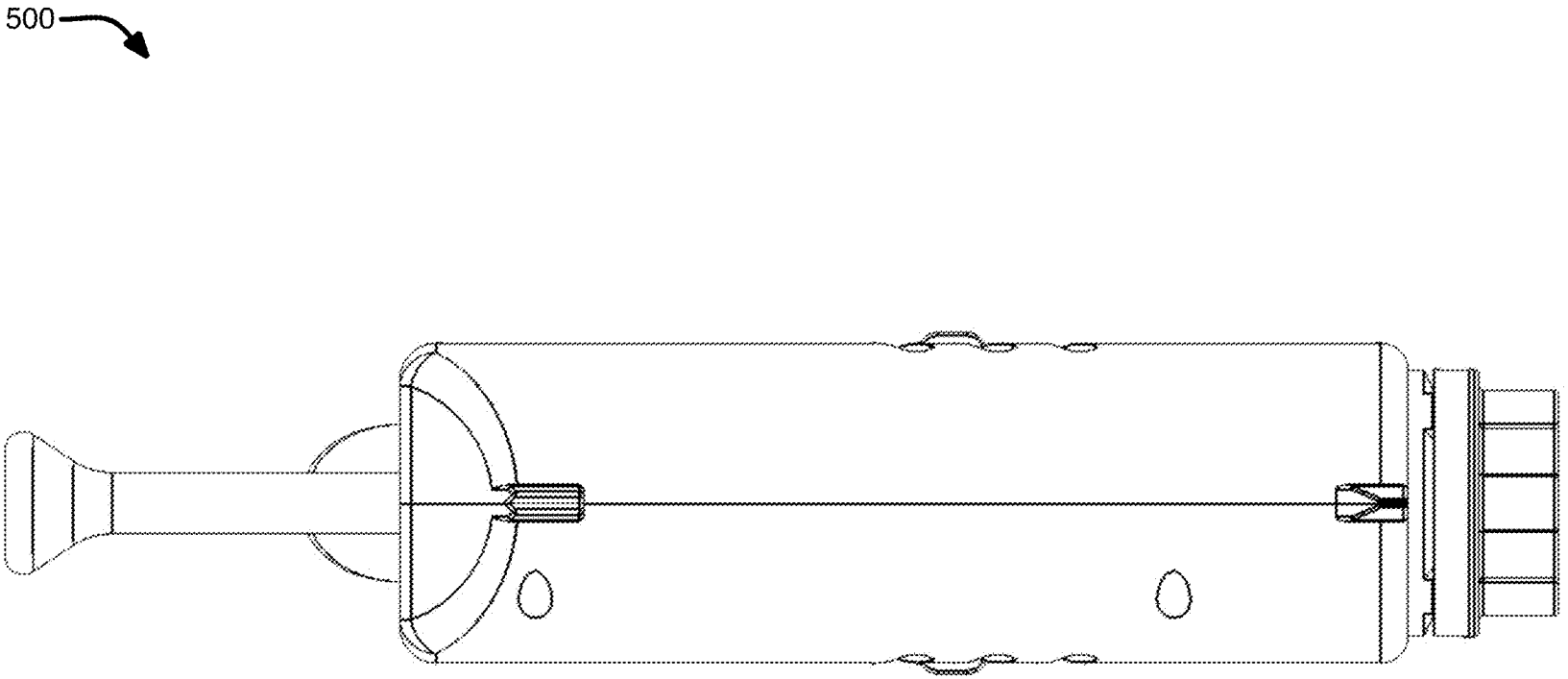
FIG. 9 is a top plan view of the vortex ring gun of FIG. 5.

FIG. 9 is a top view of gun 500.

Figure 10:
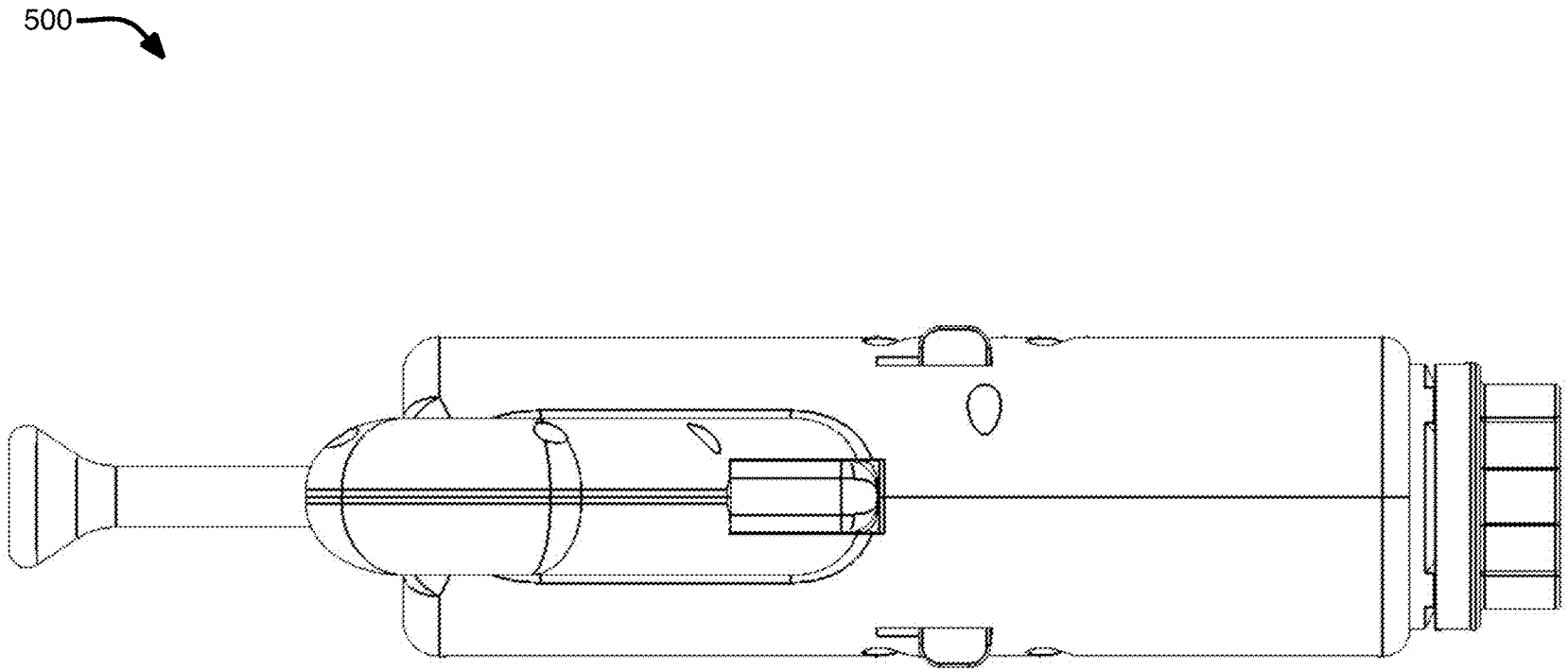
FIG. 10 is bottom plan view of the vortex ring gun of FIG. 5

FIG. 10 is a bottom view of gun 500.

Figure 11:
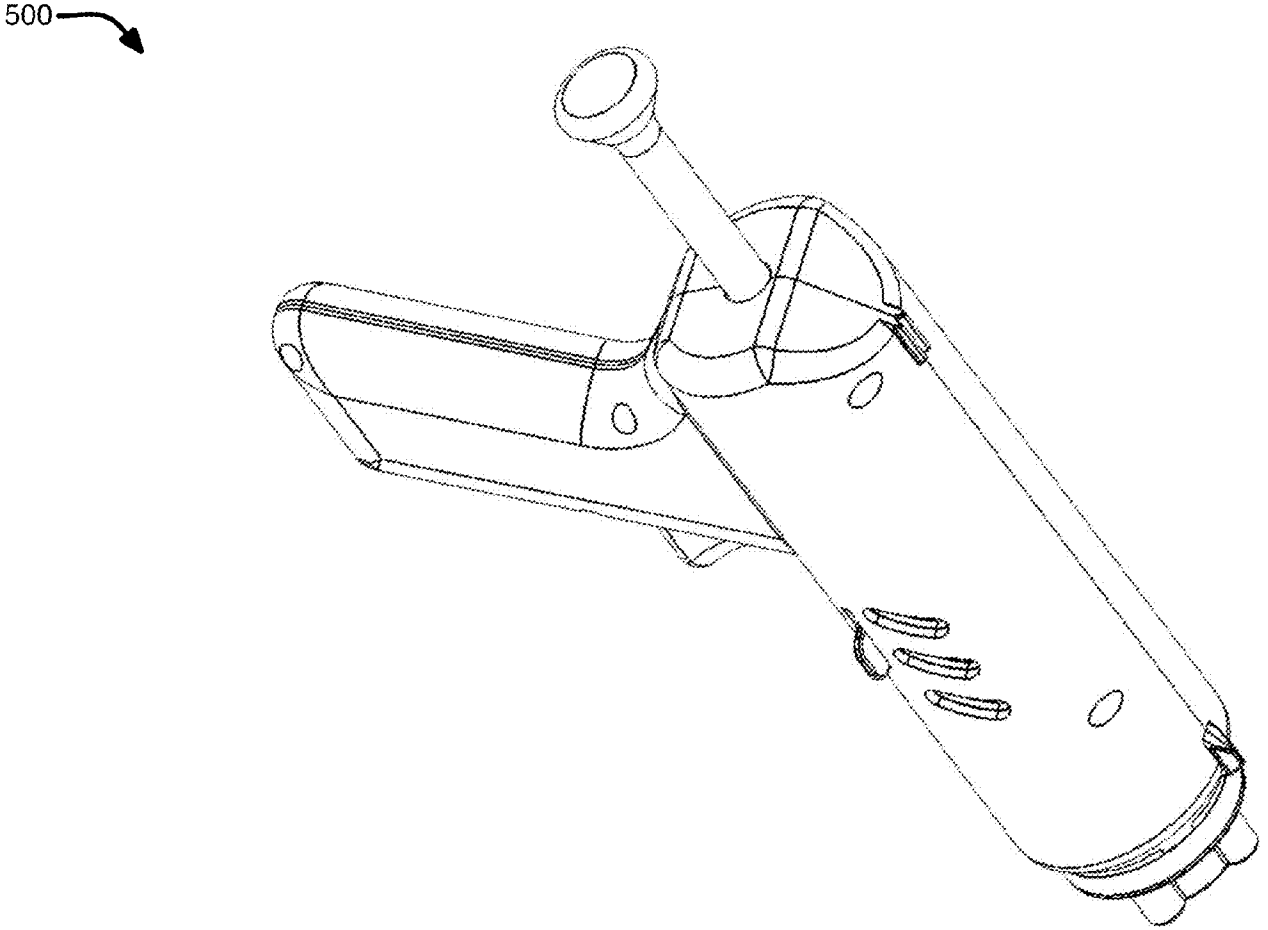
FIG. 11 is a right perspective view of the vortex ring gun of FIG. 5.

FIG. 11 is a perspective view of gun 500.

Figure 12:
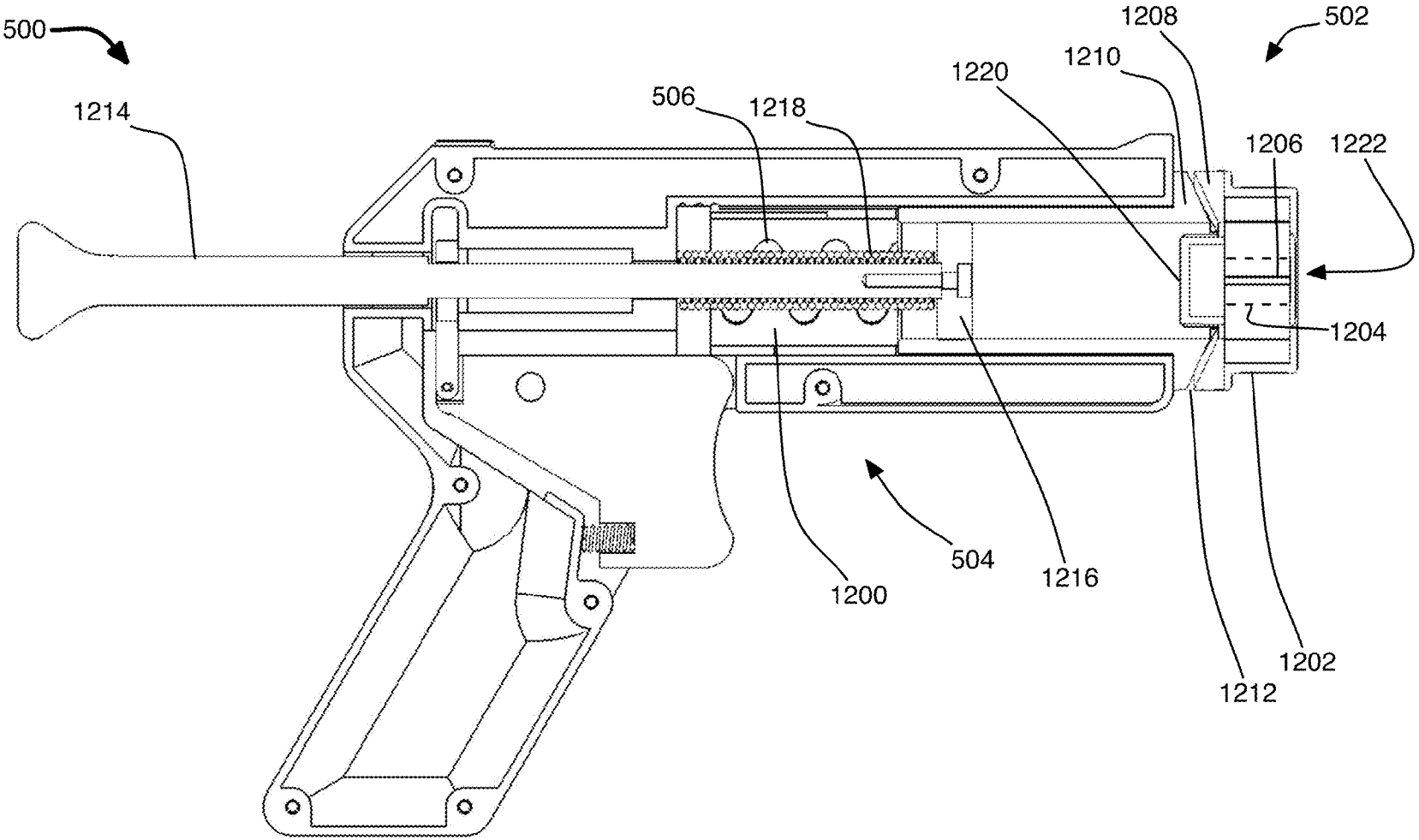
FIG. 12 is a side section view of the vortex ring gun of FIG. 5.

FIG. 12 is a side section view of gun 500. Gun 500 differs from gun 100 in at least comprising a shutter 1200 arranged to control the amount of fluid entering into gun 500 via intake slots 506. Shutter 1200 is configured to be positioned to block all, none, or a portion of intake slots 506. By positioning shutter 1200 to block at least some of intake slots 506, the rate of fluid entering or drawn into the intake slots is reduced. In at least some embodiments, shutter 1200 may be configured to block one or more of intake slots 506. In at least some embodiments, shutter 1200 slidably moves within the interior of gun 500.

In at least some embodiments, shutter 1200 comprises four positions corresponding to the shutter blocking none, one, two, or three of intake slots 506. In at least some embodiments, greater or fewer number of positions of shutter 1200 are possible.

Gun 500 also differs from gun 100 in comprising a nozzle 1202 which comprises one or more fluid reservoirs 1204 (dashed line region). In at least some embodiments, nozzle 1202 comprises four circumferentially-spaced fluid reservoirs 1204. In at least some other embodiments, nozzle 1202 comprises greater or fewer number of fluid reservoirs 1204. In at least some embodiments, fluid reservoirs 1204 are generally cylindrically-shaped regions within nozzle 1202. In at least some other embodiments, fluid reservoirs 1204 may comprise different sizes and/or different shapes. For example, in at least some embodiments, fluid reservoirs 1204 may be curvilinear-shaped.

Fluid reservoir 1204 opens to the interior of nozzle 1202 by way of a reservoir orifice 1206. Orifice 1206 is generally a rectangular-shaped opening; however, in at least some embodiments, orifice 1206 may be a different size and/or shape. In at least some other embodiments, orifice 1206 and fluid reservoir 1204 may be formed as a part of another element of gun 500. In at least some other embodiments, there may be a different relationship between the number of fluid reservoirs 1204 and orifices 1206 than a one-to-one relationship. In at least some embodiments, there may be more fluid reservoirs 1204 corresponding to each orifice 1206 and in still further embodiments there may be more orifices 1206 corresponding to each fluid reservoir 1204.

In at least some embodiments, fluid reservoirs 1204 may be coupled to be in fluid communication with a fluid tank. The fluid tank may be formed integrally as a part of gun 500 or may be a separate unit connected to gun 500. In at least some embodiments, the fluid tank may be connected with one or more fluid reservoirs 1204 by way of tubing or other connecting mechanism. In at least some other embodiments, orifices 1206 and/or fluid reservoirs 1204 may be connected to tubing or another connecting mechanism to protrude beyond a surface of a fluid within which gun 500 may be submerged, e.g., a tube may extend from the gun to above the surface of water within which the gun is being used. In accordance with at least this embodiment, the second fluid, e.g., air, may be continuously or intermittently supplied to the orifices 1206 of the gun.

Gun 500 also comprises a joint ring 1208 similar to joint ring 113 (FIG. 1). Joint ring 1208 connects nozzle 1202 to a bore sleeve 1210. The combination of joint ring 1208 adjacent bore sleeve 1210 defines pressure venting slots 1212 extending radially from the centerline of the bore sleeve. In at least some embodiments, joint ring 1208 and a nozzle 1202 may be integrally formed as a single element and referred to as nozzle assembly 502. In at least some other embodiments, joint ring 1208 and bore sleeve 1210 may be integrally formed as a single element. In some further embodiments, joint ring 1208, bore sleeve 1210, and nozzle 1202 may be integrally formed as a single element and referred to as nozzle assembly 502. In at least some embodiments, the collection of bore sleeve 1210, joint ring 1208, and/or nozzle 1202 may be referred to as nozzle assembly 502.

Gun 500 also comprises a puller 1214 axially aligned along a centerline of the barrel of the gun and connected with a piston-like member 1216 positioned in bore sleeve 1210. A spring 1218 is disposed around a portion of puller 1214 and biases the puller in one direction. In at least some embodiments, puller 1214 is biased in an open position, i.e., a position in which piston member 1216 is distal from nozzle 1202. In at least some other embodiments, puller 1214 is biased in a closed position, i.e., a position in which piston member 1216 is proximate nozzle 1202.

In at least some embodiments, piston member 1216 comprises a moveable member such as a piezoelectric element, a flexible member such as metal, plastic, coated paper, etc.

In operation, as piston member 1216 moves from a position distal from nozzle 1202, e.g., within or near shutter 1200, toward a position proximate to the nozzle the piston member propels fluid through the opening defined by bore sleeve 1210 past a blockage 1220 (similar to blockage 314) and out nozzle 1202, i.e. out nozzle opening 1222. If there is a blockage of nozzle opening 1222, then the fluid propelled by piston member 1216 exits via venting slots 1212. In at least some embodiments, a portion of fluid propelled by piston number 1216 may also exit via nozzle opening 1222 depending on the amount of blockage of the opening. Similarly, in at least some embodiments, a portion of fluid propelled by piston member 1216 may also exit via venting slots 1212 in addition to nozzle opening 1222 in the event of no blockage of the opening.

Figure 13:
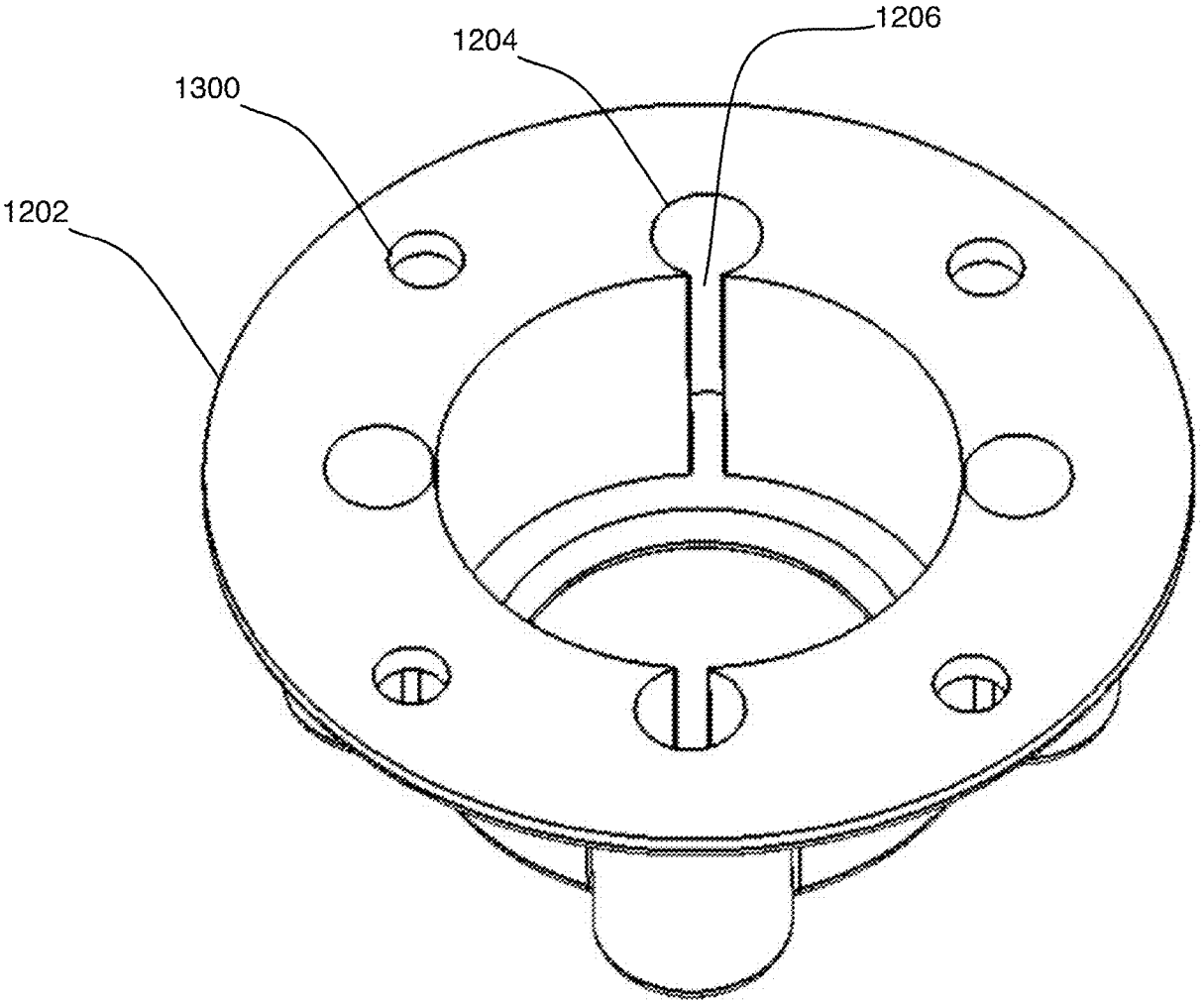
FIG. 13 is a rear perspective view of a nozzle of the vortex ring gun of FIG. 5.

FIG. 13 is a rear perspective view of nozzle 1202 (FIG. 12) of gun 500 (FIG. 5). Nozzle 1202 comprises four circumferentially-spaced fluid reservoirs 1204 which open to the interior of the nozzle via orifices 1206. Additional mounting openings 1300 defined in nozzle 1202 are used to mount the nozzle to gun 500.

In at least some embodiments, the term fluid entrapment regions may be used to refer to both or one of the fluid reservoirs and/or the fluid entrapment ribs.

Figure 14:
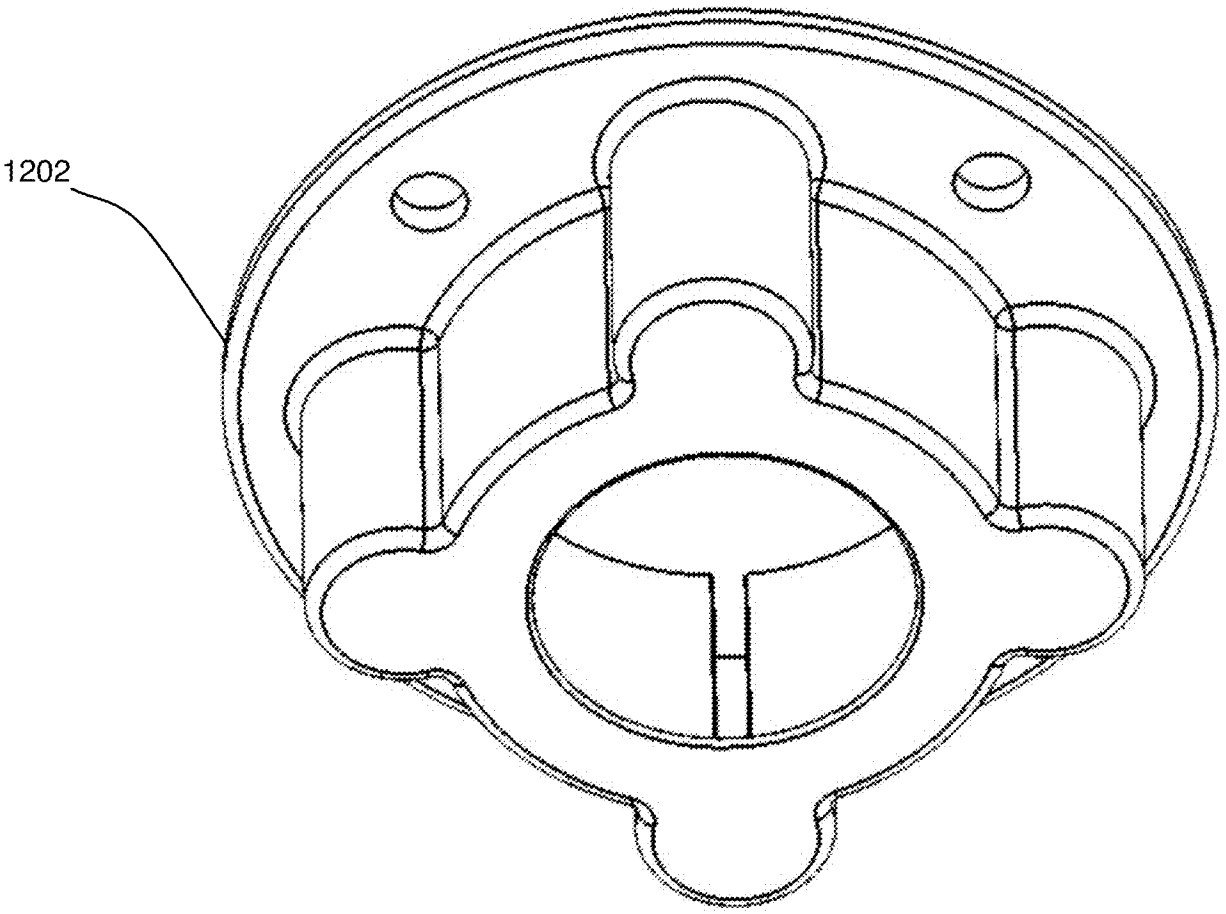
FIG. 14 is a front perspective view of the nozzle of the vortex ring gun of FIG. 5.

FIG. 14 is a front perspective view of nozzle 1202 of the vortex ring gun of FIG. 5. In at least some embodiments, the exterior surface of nozzle 1202 may be configured such that fluid entrapment regions 1204 are not visible or are less visible from the exterior. In a least some embodiments, the exterior of nozzle 1202 may be the same as nozzle 112 (FIG. 1).

Figure 15:
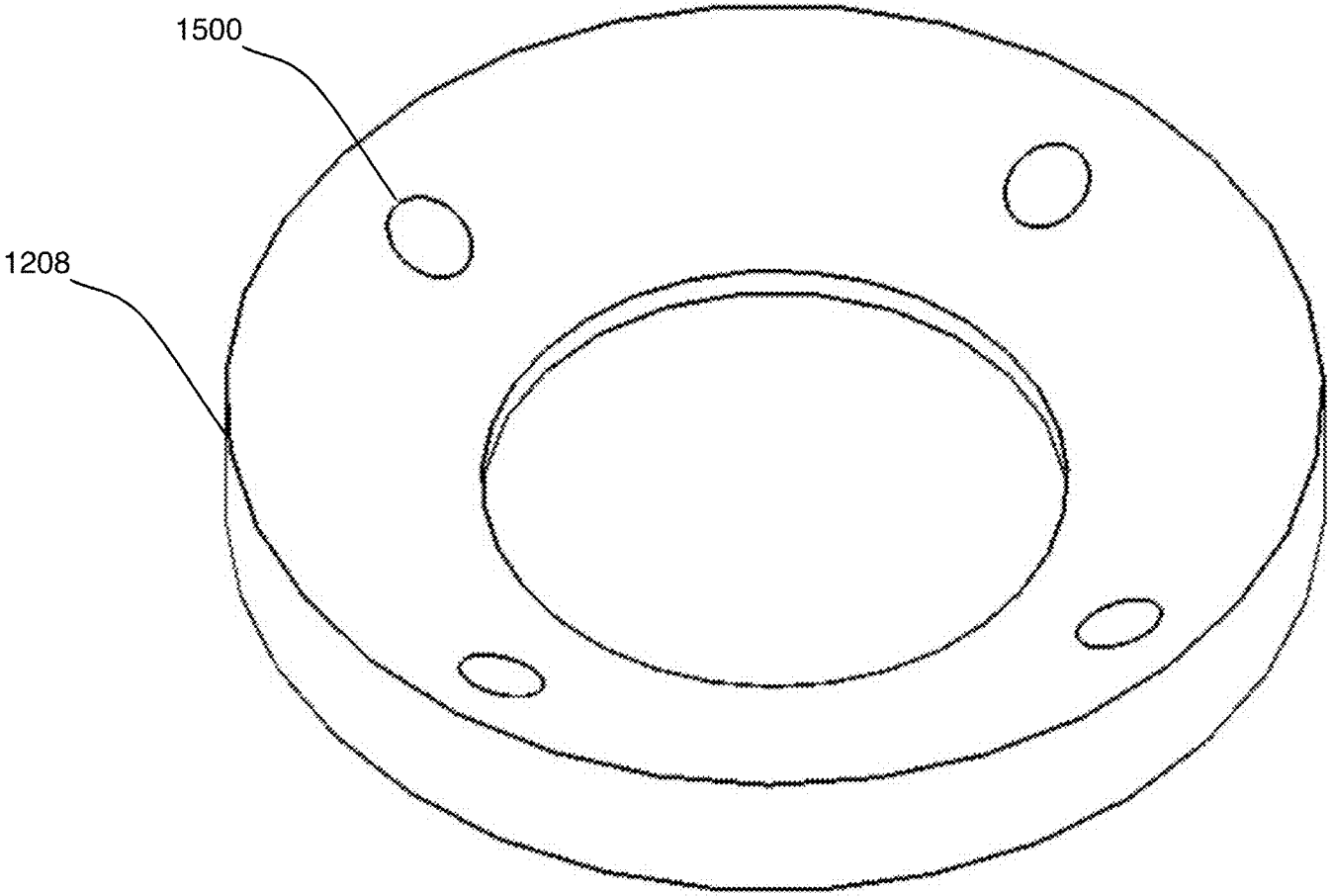
FIG. 15 is a rear perspective view of a joint ring of the vortex ring gun of FIG. 5.

FIG. 15 is a rear perspective view of joint ring 1208 (FIG. 12) of the vortex ring gun of FIG. 5. Similar to mounting openings 1300 (FIG. 13), joint ring 1208 comprises mounting openings 1500. As depicted, the rear surface of joint ring 1208 slopes from the outer perimeter down to the inner perimeter of the joint ring, i.e., the thickness of the joint ring decreases moving from the outer circumference to the inner circumference.

Figure 16:
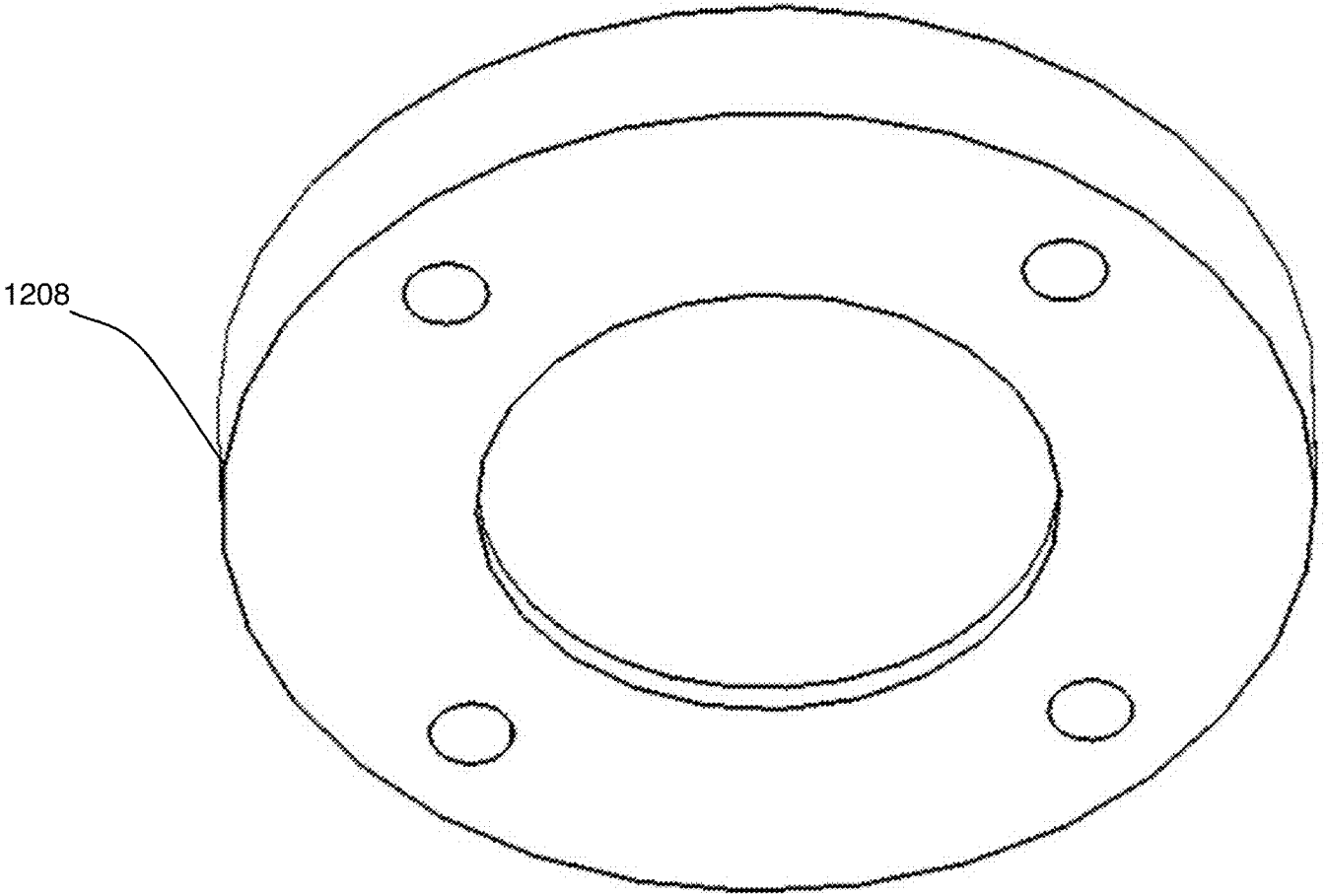
FIG. 16 is a front perspective view of the joint ring of the vortex ring gun of FIG. 5.

FIG. 16 is a front perspective view of joint ring 1208 (FIG. 12) of the vortex ring gun of FIG. 5.

Figure 17:
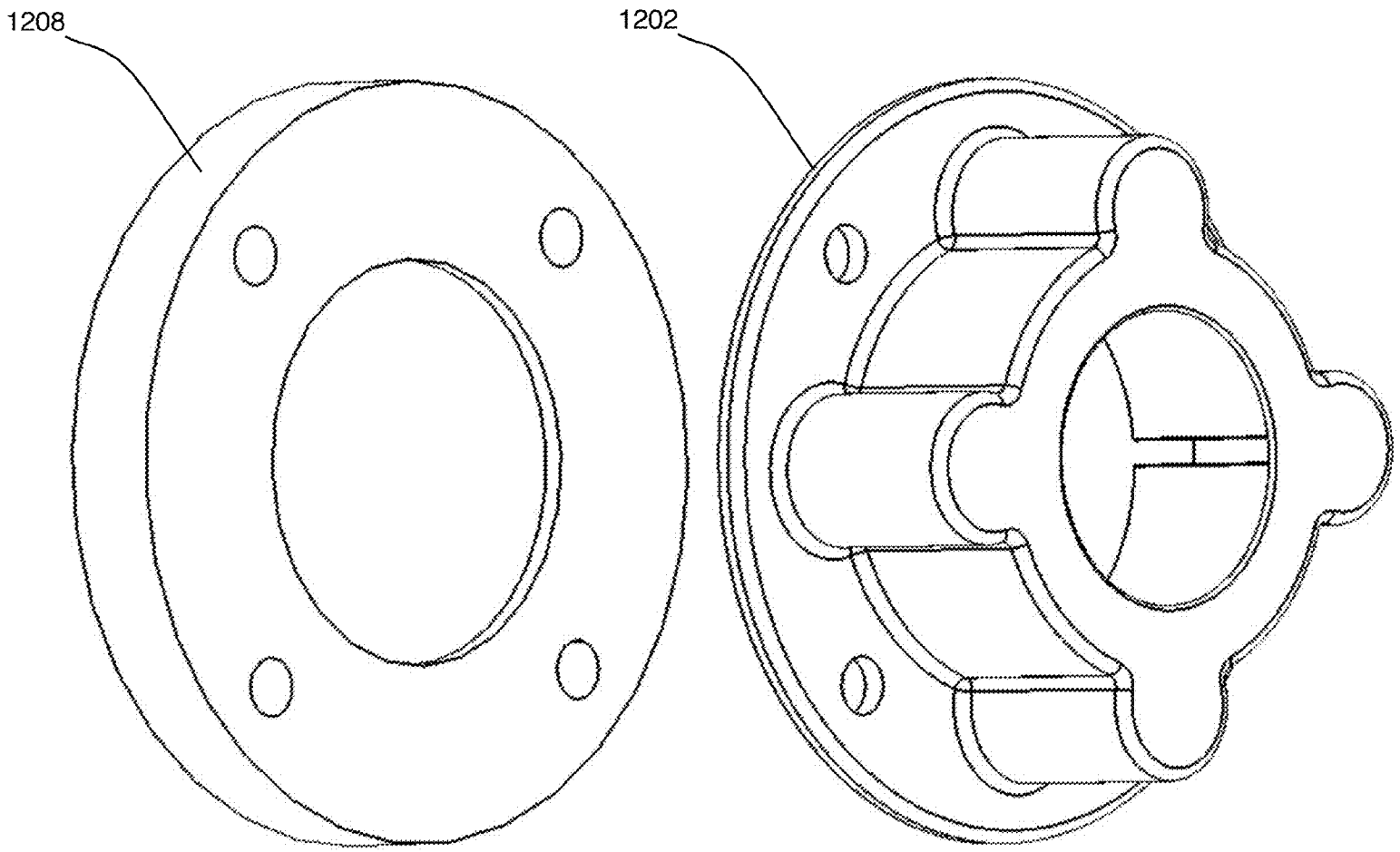
FIG. 17 is a front perspective exploded view of the nozzle and the joint ring of the vortex ring gun of FIG. 5.

FIG. 17 is a front perspective, exploded view of nozzle 1202 and joint ring 1208 of the vortex ring gun of FIG. 5. As depicted, nozzle 1202 is axially aligned with joint ring 1208. Mounting openings 1300 and 1500 align to mount nozzle 1202 and joint ring 1208 to gun 500.

Figure 18:
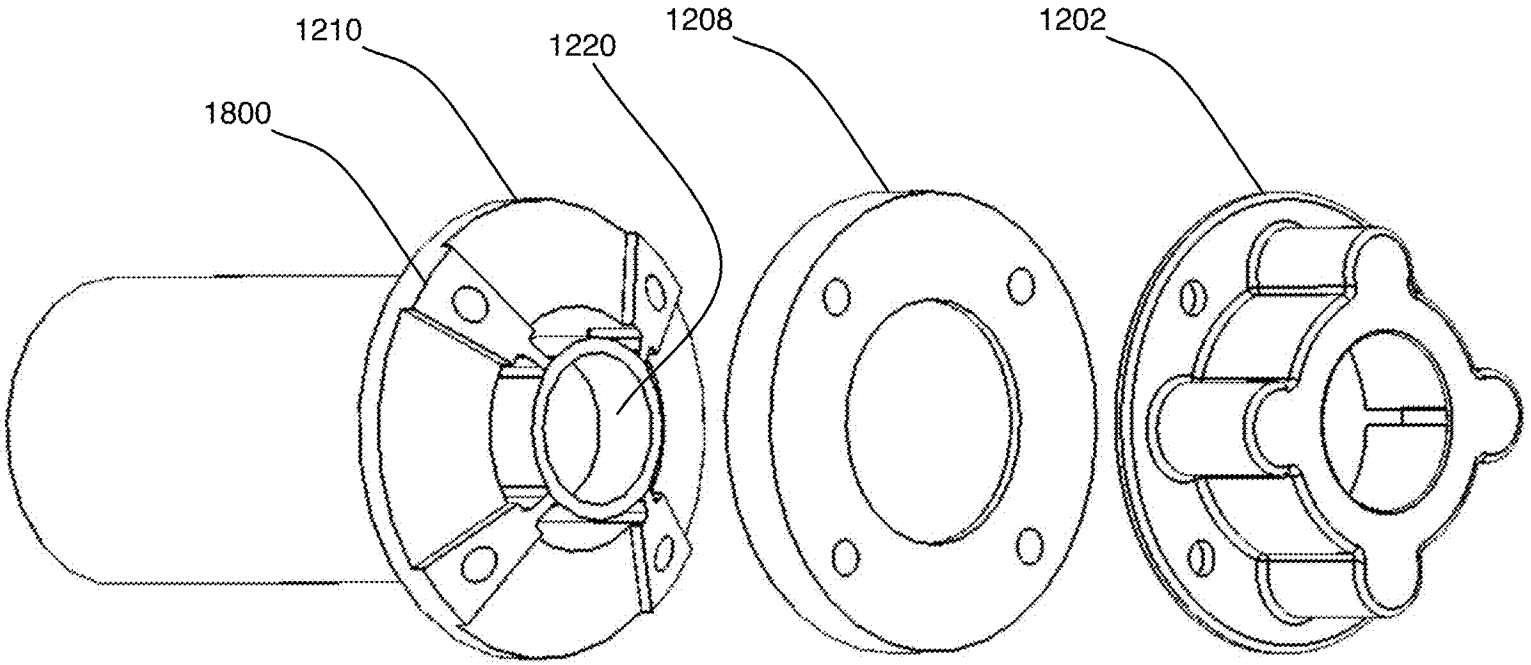
FIG. 18 is a front perspective exploded view of the nozzle, the joint ring, and the bore sleeve of the vortex ring gun of FIG. 5.

FIG. 18 is a front perspective, exploded view of nozzle 1202, joint ring 1208, and bore sleeve 1210 of the vortex ring gun of FIG. 5. Bore sleeve 1210 comprises raised radial segments 1800 radially-spaced around a centerline of the bore sleeve. Joint ring 1208 positioned atop bore sleeve 1210 contacts raised radial segments 1800 causing the definition of venting slots 1212 on the remaining surface of the bore sleeve. That is, joint ring 1208 does not contact the entire surface of bore sleeve 1210.

Blockage 1220, also visible in FIG. 18, is similar to blockage 314 (FIG. 3).

Figure 19:
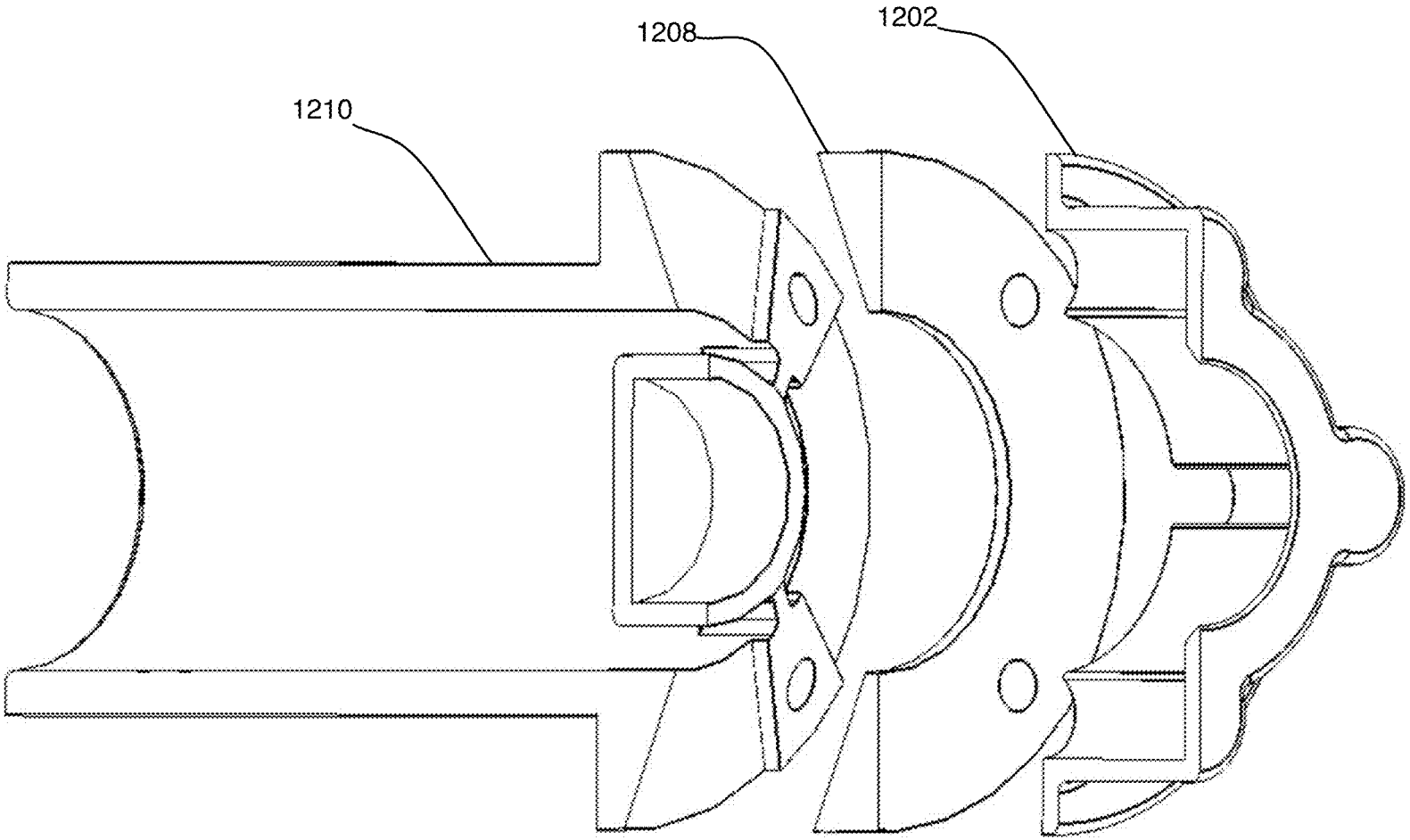
FIG. 19 is a side section view of FIG. 18.

FIG. 19 is a side section view of FIG. 18.

Figure 20:
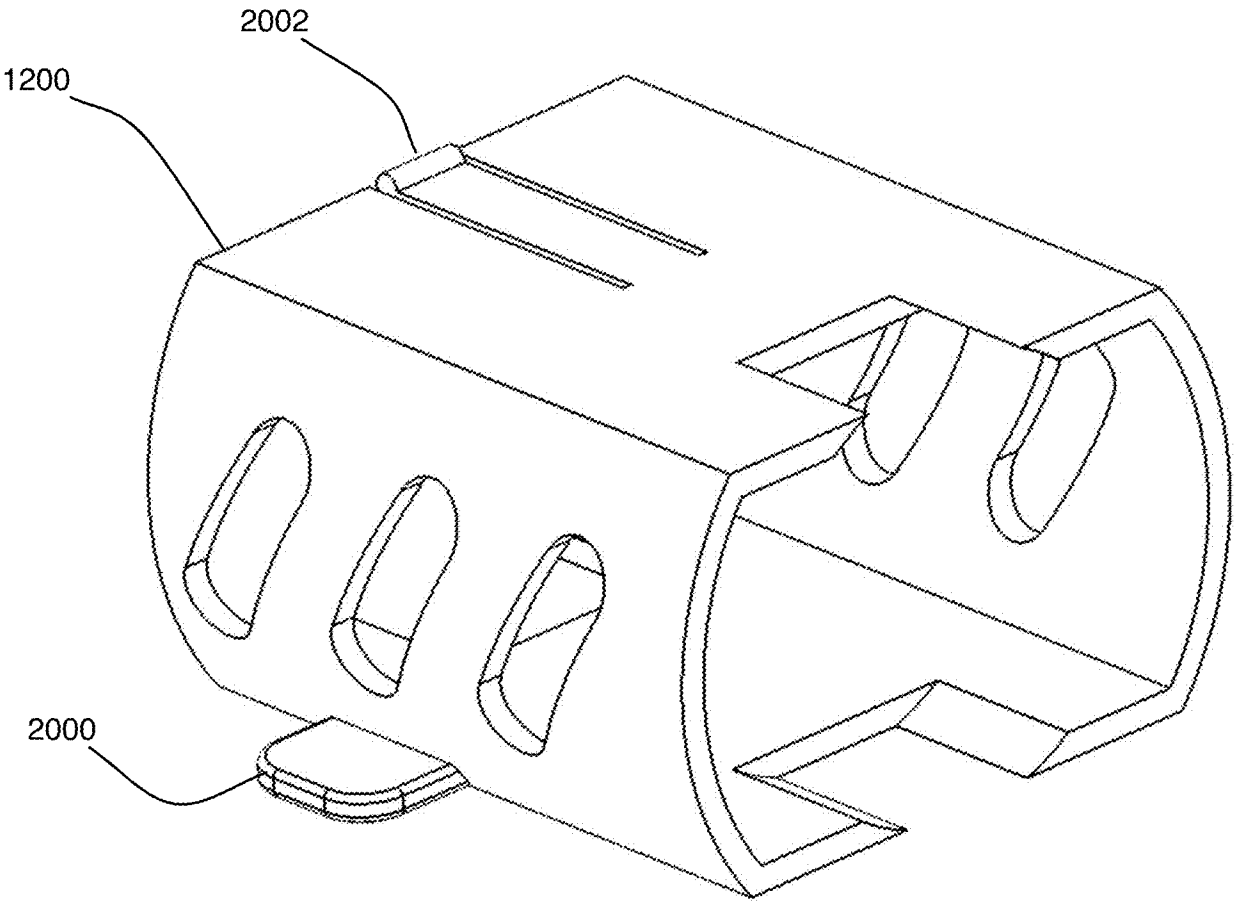
FIG. 20 is a perspective view of a shutter of the vortex ring gun of FIG. 5.

FIG. 20 is a perspective view of shutter 1200 (FIG. 12) of the vortex ring gun of FIG. 5. Shutter 1200 comprises a lever 2000 for controlling the position of the shutter within gun 500. In at least some embodiments, shutter 1200 comprises a single lever while in other embodiments the shutter may comprise a different shaped, different sized, or greater or less number of levers.

Shutter 1200 also comprises a positioning finger 2002 along a surface of the shutter for retaining the shutter in position with respect to the interior of gun 500. In at least some embodiments, positioning finger 2002 is a resilient or flexible member. In at least some embodiments, positioning finger 2002 interacts with one or more detents within gun 500 to retain shutter 1200 in position.

Figure 21:
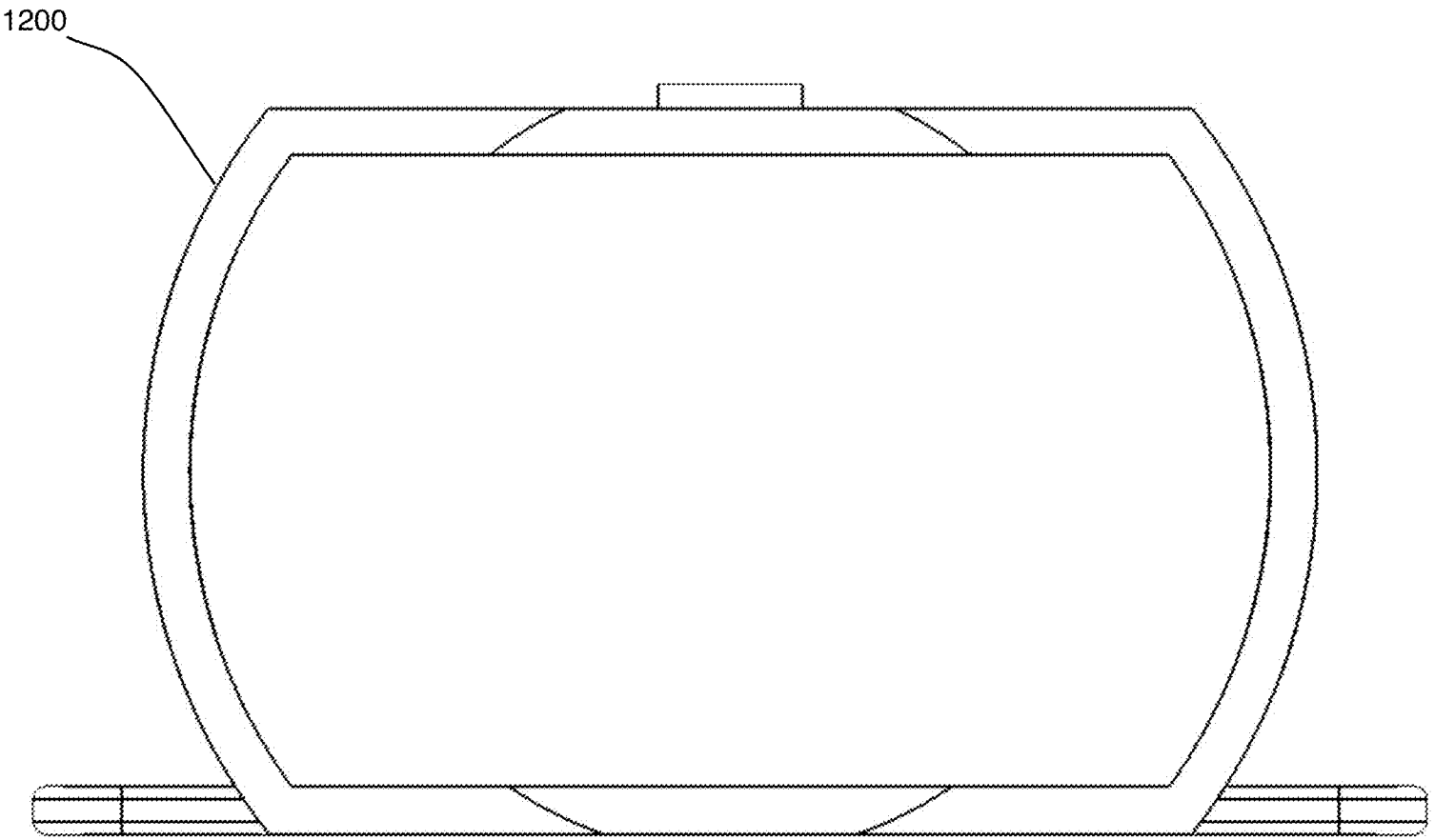
FIG. 21 is an end view of the shutter of the vortex ring gun of FIG. 5.

FIG. 21 is an end view of shutter 1200 of the vortex ring gun of FIG. 5. As depicted, shutter 1200 comprises rounded sides to conform to the shape of the interior of gun 500. In at least some embodiments, shutter 1200 does not have rounded sides. In at least some other embodiments, shutter 1200 is circular in cross-section.

Figure 22:
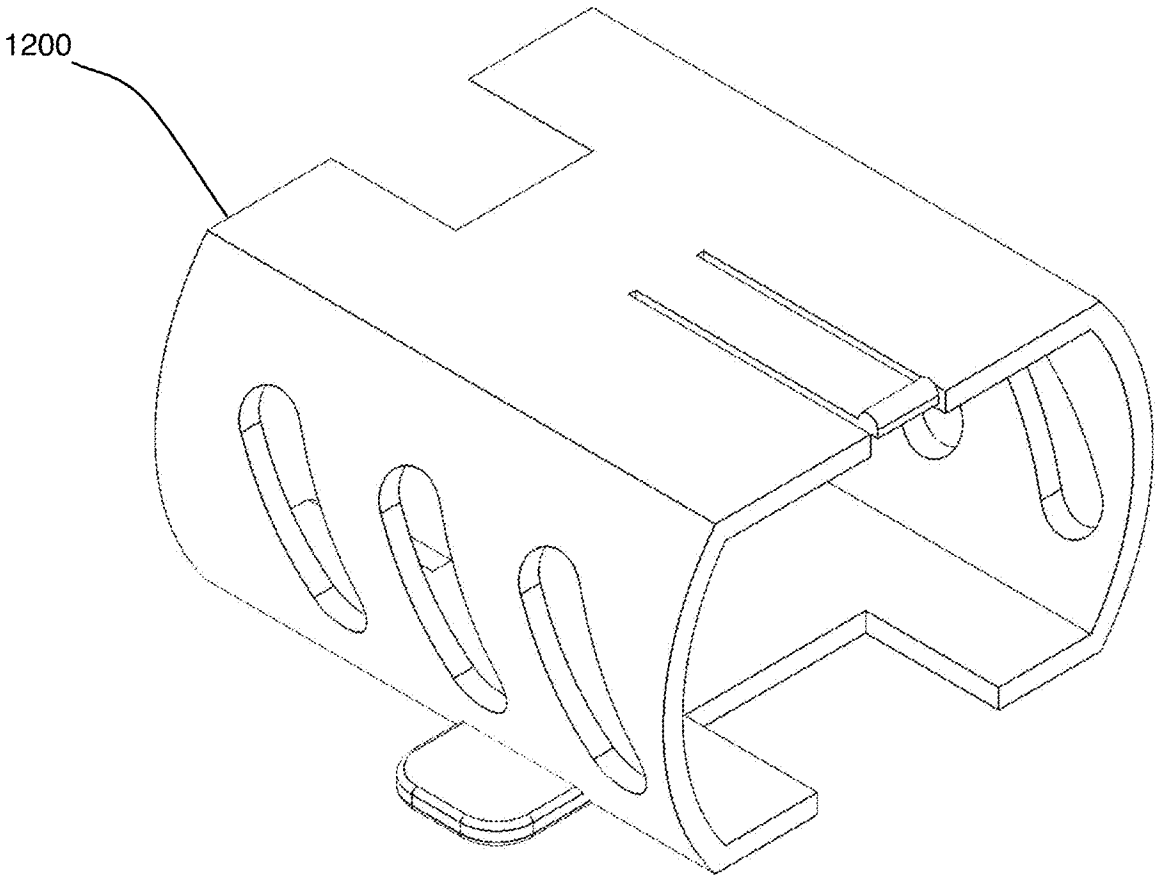
FIG. 22 is another perspective view of the shutter of the vortex ring gun of FIG. 5.

FIG. 22 is another perspective view of shutter 1200 of the vortex ring gun of FIG. 5.

Figure 23:
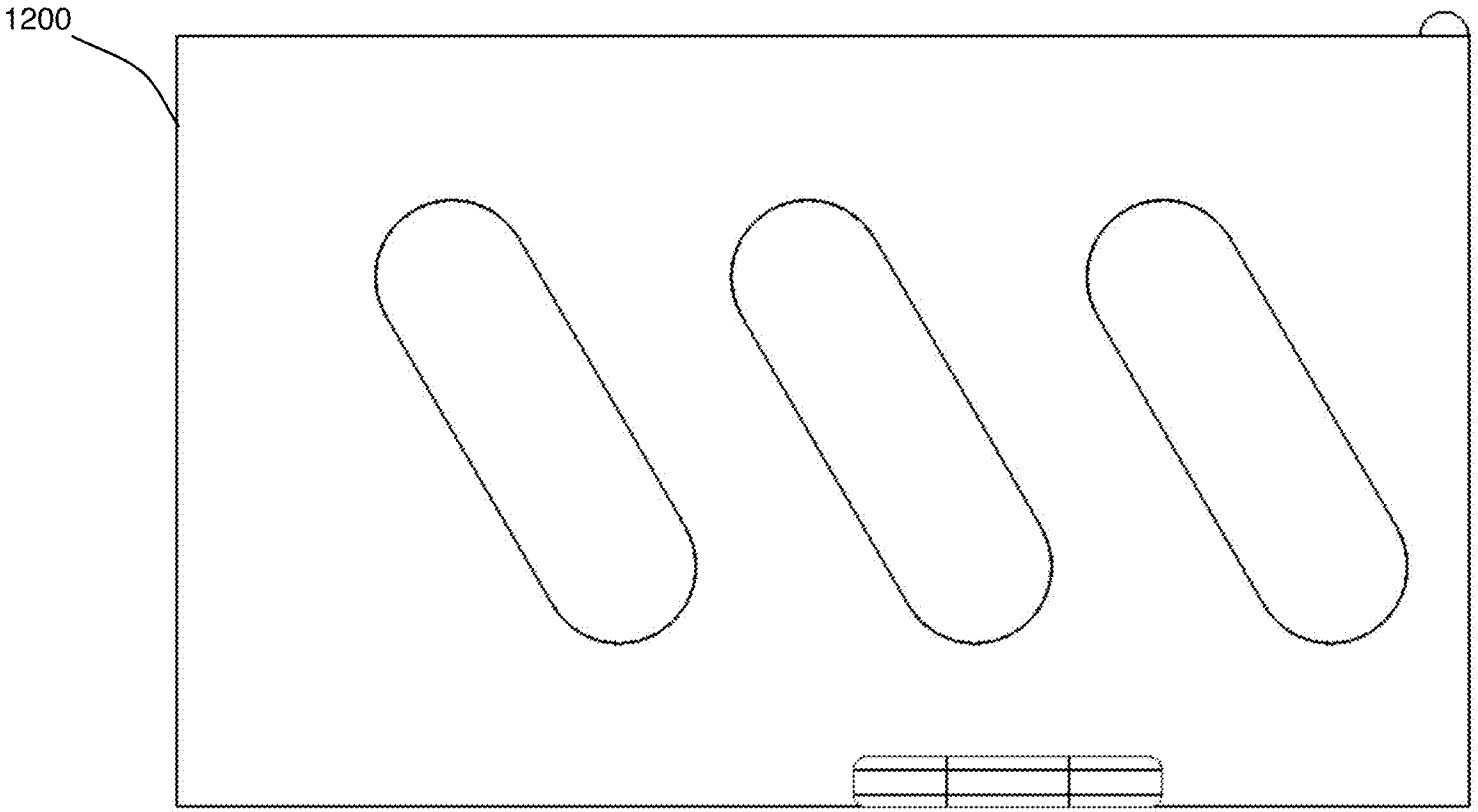
FIG. 23 is a side view of the shutter of the vortex ring gun of FIG. 5.

FIG. 23 is a side view of shutter 1200 of the vortex ring gun of FIG. 5.

Figure 24:
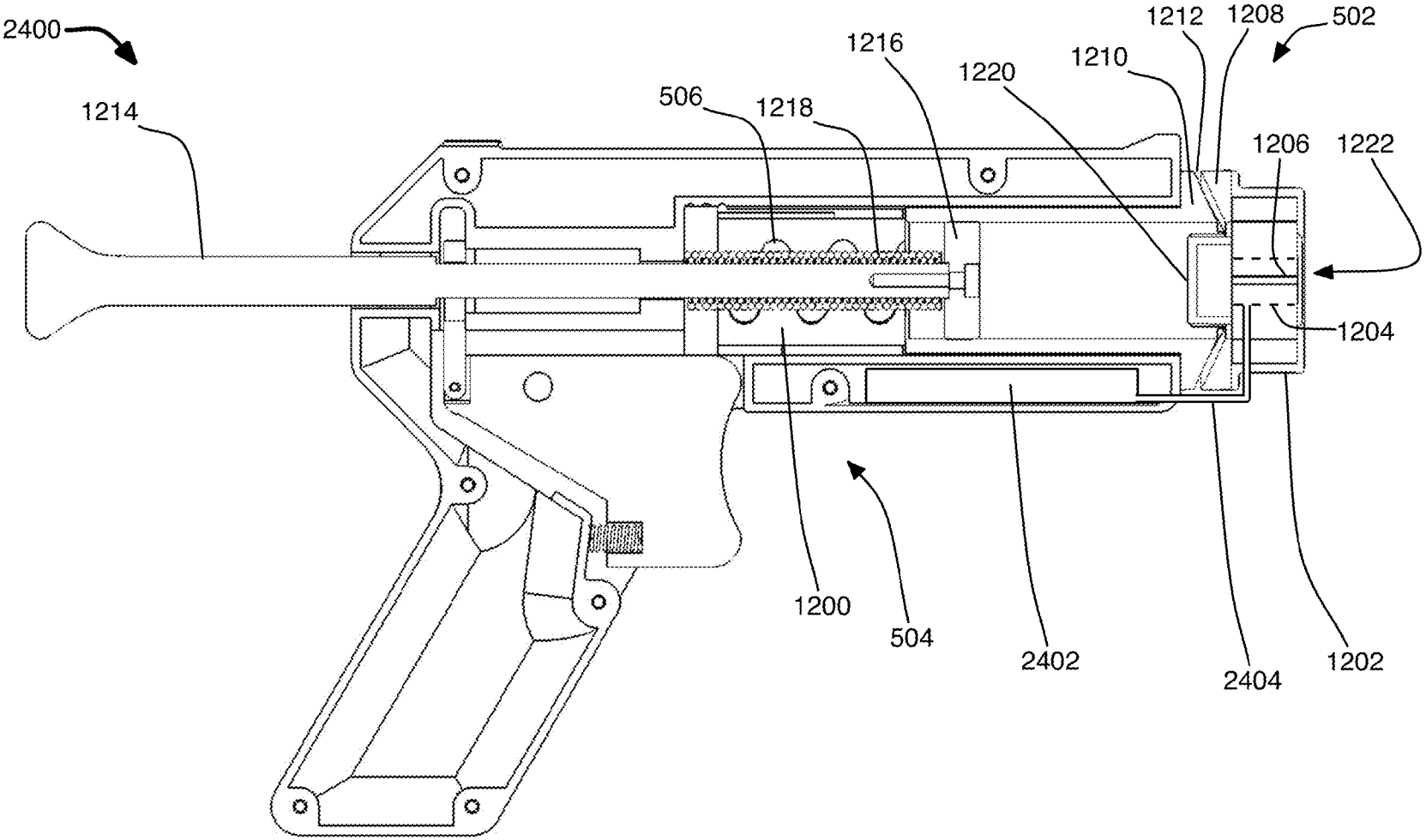
FIG. 24 is a side section view of a vortex ring gun according to another embodiment.

FIG. 24 is a side section view of a vortex ring gun 2400 according to another embodiment similar to gun 500 (FIG. 5). Gun 2400 comprises a fluid supply tank 2402 positioned within a lower portion of the gun. In the depicted embodiment, fluid supply tank 2402 is positioned within gun 2400 below bore sleeve 1210. Fluid supply tank 2402 is coupled with fluid reservoir 1204 via a supply line 2404. In at least some embodiments, the entirety of fluid supply tank 2402 and supply line 2404 are positioned within gun 2400. In at least some other embodiments, all or a portion of fluid supply tank 2402 and/or supply line 2404 are positioned external to gun 2400. In at least some embodiments, different size, shape, volume, and/or positionings of the fluid supply tank are contemplated.

In at least some embodiments, one or more additional fluid supply tanks may be positioned in gun 2400 and connected via one or more supply lines to one or more of the fluid reservoirs. In at least some embodiments, fluid supply tank 2402 supplies a second fluid to fluid reservoir 1204, e.g., air or another gas, a colored fluid, a colorant, etc.

In at least some embodiments, fluid supply tank 2402 comprises an opening to the exterior of gun 2400 through which a second fluid, e.g., air or another gas, colorant, a colored fluid, etc., may be added.

Figure 25:
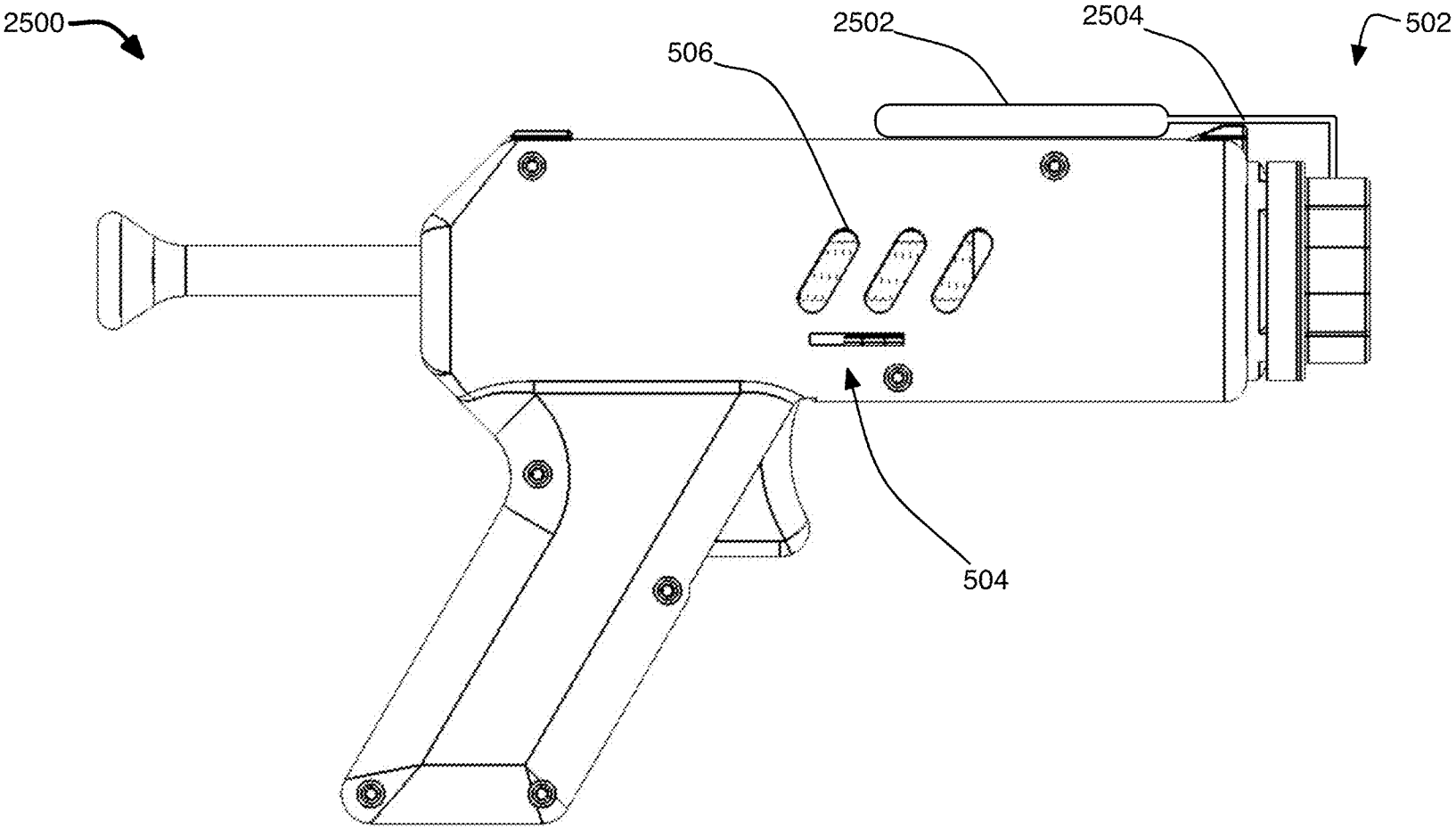
FIG. 25 is a side view of a vortex ring gun according to another embodiment.

FIG. 25 is a side view of a vortex ring gun 2500 according to another embodiment similar to gun 2400 (FIG. 24). Gun 2500 comprises an externally-positioned fluid supply tank 2502 positioned external to the gun. In the depicted embodiment, fluid supply tank 2502 is positioned mounted on top of the gun. In at least some embodiments, different size, shape, volume, and/or positionings of the fluid supply tank are contemplated. Fluid supply tank 2502 is coupled with fluid reservoir 1204 via a supply line 2504. In at least some embodiments, the entirety of fluid supply tank 2502 and supply line 2504 are positioned external to gun 2500. In at least some other embodiments, all or a portion of fluid supply tank 2502 and/or supply line 2504 are positioned internal to gun 2500.

In at least some embodiments, one or more additional fluid supply tanks may be positioned on gun 2500 and connected via one or more supply lines to one or more of the fluid reservoirs. In at least some embodiments, fluid supply tank 2502 supplies a second fluid to fluid reservoir 1204, e.g., air or another gas, a colored fluid, a colorant, etc.

In at least some embodiments, fluid supply tank 2502 comprises an opening to the exterior of gun 2500 through which a second fluid, e.g., air or another gas, a colorant, a colored fluid, etc., may be added.

Figure 26:
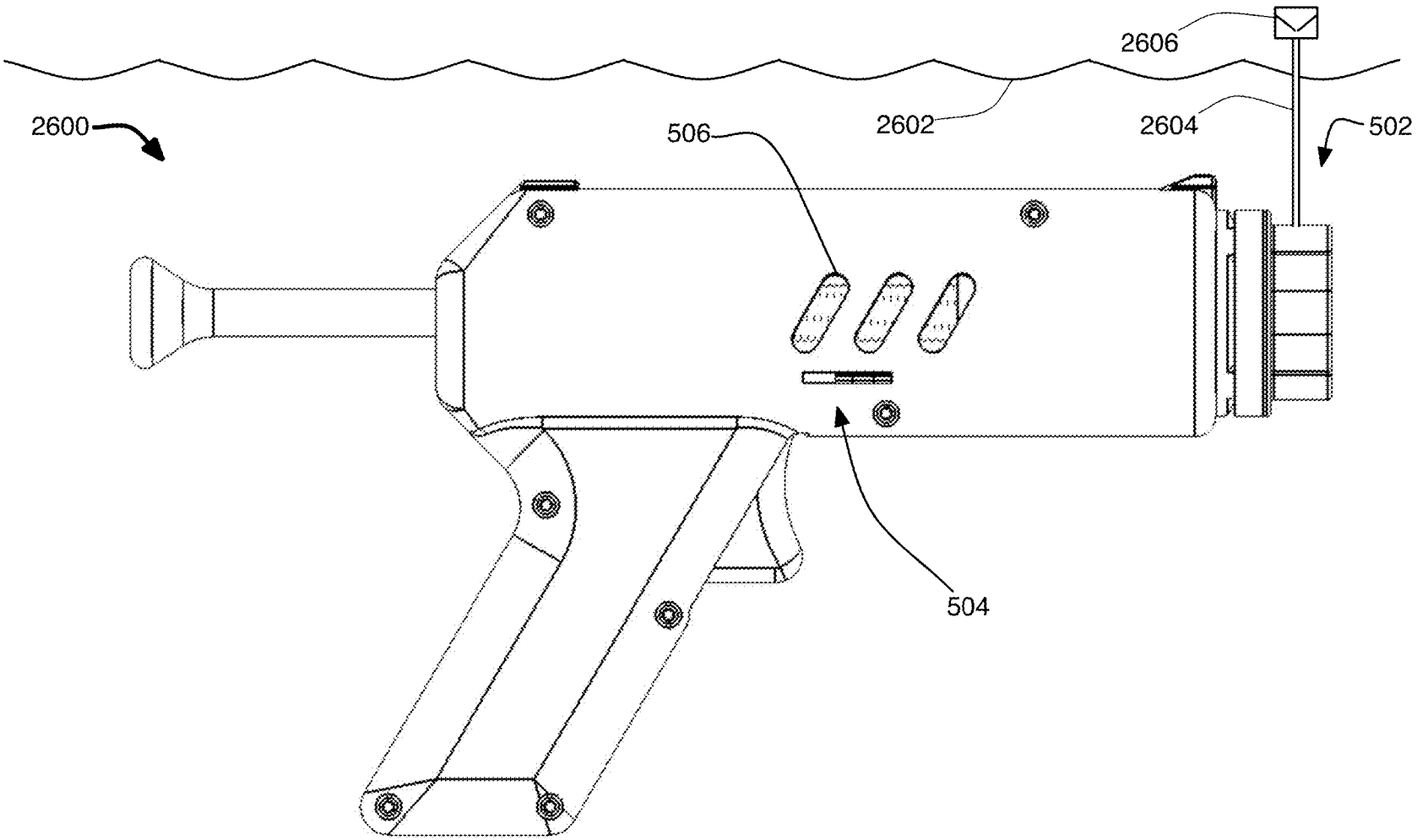
FIG. 26 is a side view of a vortex ring gun according to another embodiment.

FIG. 26 is a side view of a vortex ring gun 2600 according to another embodiment. FIG. 26 is a view of gun 2600 submerged below a water surface level 2602. Gun 2600 comprises a supply line 2604 extending an open end above level 2602 and connected at another end to at least one of the one or more fluid reservoirs 1204. In at least some embodiments, supply line 2604 is comprised of a rigid, flexible, or semi-rigid material. Supply line 2604 also comprises a one-way valve 2606 to allow entry of air from above level 2602 into fluid reservoir 1204 and prevent exit of same. In at least some embodiments, supply line 2604 does not include one-way valve 2606. In at least some other embodiments, valve 2606 is positioned and/or attached or formed as part of fluid reservoir 1204 or another piece of gun 500.

In at least some embodiments, gun 100, 500, 2400, 2500, 2600 is used to produce a vortex ring while submerged below the surface of a liquid, e.g., while submerged in water. In at least some embodiments, the vortex ring produced by gun 100, 500, 2400, 2500, 2600 comprises a second fluid, e.g., a colorant or air bubbles.

In at least some embodiments, the second fluid and/or colorant has a lower density than the first fluid, e.g., the fluid propelled by piston member 306 or 1216. Because of the lower density, the second fluid and/or colorant moves toward the core of the generated vortex ring as opposed to the periphery of the ring. In at least some embodiments, the generated vortex ring retains the second fluid and/or colorant for a longer time period and/or the second fluid and/or colorant is not lost to the surrounding first fluid through which the generated vortex ring travels.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A vortex ring producing gun comprising:

a body defining a first interior volume;

a moveable element positioned in fluid communication with the first interior volume;

a nozzle assembly coupled with the body at an opening of the body, the nozzle assembly comprising:

a nozzle comprising a nozzle opening located distal from the body, wherein the nozzle opening is configured to produce a vortex ring and connect the first interior volume to an exterior of the vortex ring producing gun; and one or more fluid entrapment chambers within the nozzle assembly between the body and the nozzle opening, wherein each fluid entrapment chamber of the one or more fluid entrapment chambers is formed by a pair of connecting ribs extending from an inner surface of the nozzle assembly toward the nozzle opening, and each fluid entrapment chamber of the one or more fluid entrapment chambers defines a separate interior volume in fluid communication with the first interior volume; and a joint ring configured to connect the nozzle assembly to the body, the joint ring comprising:

at least one pressure venting slot configured to provide a fluid path between an interior of the nozzle assembly and the exterior of the vortex ring producing gun.

2. The gun as claimed in claim 1, wherein the one or more fluid entrapment chambers are circumferentially spaced about the nozzle opening.

3. The gun as claimed in claim 1, wherein a relative position of the nozzle and the joint ring to each other defines the at least one pressure venting slot.

4. The gun as claimed in claim 1, further comprising:

a bore sleeve coupled between the body and the joint ring, wherein a relative position of the joint ring and the bore sleeve to each other defines the at least one pressure venting slot.

5. The gun as claimed in claim 1, further comprising a blockage positioned at least partially within at least one of the body, or the nozzle assembly.

6. The gun as claimed in claim 5, wherein the blockage is a central blockage positioned along a centerline of at least one of the body, or the nozzle assembly.

7. The gun as claimed in claim 5, wherein the blockage is arranged to prevent insertion of objects into said body.

8. The gun as claimed in claim 5, wherein the blockage comprises a face having an area greater than half an interior area of the nozzle assembly.

9. The gun as claimed in claim 5, wherein the blockage comprises a cavity arranged to receive a soluble colorant.

10. The gun as claimed in claim 9, wherein the cavity is formed in the face of the blockage and opens away from the body.

11. The gun as claimed in claim 1, further comprising an orifice adjacent at least one of the first interior volume or the nozzle assembly and the orifice is arranged to receive a soluble colorant.

12. The gun as claimed in claim 11, further comprising a pellet comprising a soluble colorant, the pellet sized to fit within the orifice and arranged to cause fluid within at least a portion of the gun to become colored by the colorant.

13. The gun as claimed in claim 11, further comprising a capsule comprising a soluble colorant, the capsule sized to fit within the orifice and arranged to cause fluid within at least a portion of the gun to become colored by the colorant.

14. The gun as claimed in claim 11, further comprising a soluble colorant wherein the soluble colorant has a density less than the density of a fluid surrounding the gun.

15. The gun as claimed in claim 1, wherein the at least one pressure venting slot comprises a plurality of pressure venting slots circumferentially disposed about the interior surface of the nozzle assembly and radially extending from the interior of the nozzle assembly.

16. The gun as claimed in claim 15, the pressure venting slots extending at an acute angle to the axis of the nozzle assembly.

17. The gun as claimed in claim 5, wherein the at least one pressure venting slot comprises a plurality of pressure venting slots circumferentially disposed about the interior surface of the nozzle assembly and radially extending from the interior surface.

18. The gun as claimed in claim 17, the pressure venting slots extending at an acute angle to the axis of the nozzle assembly.

19. The gun as claimed in claim 1, wherein the fluid entrapment chambers comprise one or more fluid reservoirs.

20. The gun as claimed in claim 19, the fluid reservoirs comprising a cylindrical-shaped region defined as part of the nozzle assembly.

21. The gun as claimed in claim 19, the nozzle assembly defining a reservoir orifice arranged to provide fluid communication between the interior of the nozzle assembly and the fluid reservoir.

22. The gun as claimed in claim 1, wherein the moveable element is a piston.

23. The gun as claimed in claim 1, further comprising:

a fluid supply connected with one or more of the fluid entrapment chambers.

24. The gun as claimed in claim 23, wherein the fluid supply comprises at least one of an internal supply positioned at least partially internal to the gun, an external supply positioned at least partially external to the gun, or ambient air.

25. The gun as claimed in claim 24, further comprising a supply line connecting the fluid supply to at least one of the fluid entrapment chambers.

26. The gun as claimed in claim 24, wherein the fluid supply comprises a supply tank.

27. The gun as claimed in claim 5, further comprising:

a fluid supply connected with one or more of the fluid entrapment chambers.

28. The gun as claimed in claim 27, wherein the fluid supply comprises at least one of an internal supply positioned at least partially internal to the gun, an external supply positioned at least partially external to the gun, or ambient air.

29. The gun as claimed in claim 28, further comprising a supply line connecting the fluid supply to at least one of the fluid entrapment chambers.

30. The gun as claimed in claim 28, wherein the fluid supply comprises of a supply tank.

* * * * *